US012369692B2

(12) United States Patent
Siegismund

(10) Patent No.: US 12,369,692 B2
(45) Date of Patent: Jul. 29, 2025

(54) FASTENING MECHANISM FOR AN ARTICLE OF FOOTWEAR

(71) Applicant: PUMA SE, Herzogenaurach (DE)

(72) Inventor: Andreas Siegismund, Rueckersdorf (DE)

(73) Assignee: PUMA SE, Herzogenaurach (DE)

( * ) Notice: Subject to any disclaimer, the term of this patent is extended or adjusted under 35 U.S.C. 154(b) by 45 days.

(21) Appl. No.: 18/205,086

(22) Filed: Jun. 2, 2023

(65) Prior Publication Data

US 2023/0389655 A1 Dec. 7, 2023

Related U.S. Application Data

(60) Provisional application No. 63/348,712, filed on Jun. 3, 2022.

(51) Int. Cl.
*A43C 11/00* (2006.01)

(52) U.S. Cl.
CPC ..... *A43C 11/006* (2013.01)

(58) Field of Classification Search
CPC ..... A43C 11/006; A43C 11/165; A43C 11/16; A43C 11/20
See application file for complete search history.

(56) References Cited

U.S. PATENT DOCUMENTS

| | | | | |
|---|---|---|---|---|
| 3,808,644 | A * | 5/1974 | Schoch | A43C 11/16 36/50.1 |
| 5,177,882 | A * | 1/1993 | Berger | A43C 11/165 36/50.1 |
| 5,327,662 | A * | 7/1994 | Hallenbeck | A43C 11/00 36/50.1 |
| 8,061,061 | B1 * | 11/2011 | Rivas | A43C 11/165 36/137 |
| 9,737,115 | B2 * | 8/2017 | Soderberg | A43C 1/06 |
| 11,033,079 | B2 * | 6/2021 | Bock | A43C 11/20 |
| 2020/0085144 | A1 * | 3/2020 | Chiou | A43C 11/165 |

FOREIGN PATENT DOCUMENTS

| | | | | |
|---|---|---|---|---|
| KR | 200232518 Y1 * | 9/2001 | | A43C 11/165 |
| WO | WO-2023233375 A1 * | 12/2023 | | A43C 11/006 |

* cited by examiner

*Primary Examiner* — Jameson D Collier
(74) *Attorney, Agent, or Firm* — Quarles & Brady LLP

(57) ABSTRACT

A fastening mechanism for an article of footwear, the fastening mechanism including a tensioning member having a member opening, a first tensioning element extending along a first side of an upper of the footwear, and a second tensioning element extending along a second side of the upper, opposite the first side. The first and second tensioning elements are operatively coupled with the tensioning member about the member opening. The fastening mechanism is configured to be moveable between a loosened configuration, in which the first and the second tensioning elements are tensioned to a first tension, to a tightened configuration, in which the first and the second tensioning elements are tensioned to a second tension that is greater than the first tension, when the tensioning member is rotated relative to the article of footwear.

16 Claims, 12 Drawing Sheets

FASTENING MECHANISM FOR AN ARTICLE OF FOOTWEAR

CROSS REFERENCE TO RELATED APPLICATIONS

This application claims the benefit of and priority from U.S. Provisional Application No. 63/348,712, filed on Jun. 3, 2022, and entitled "ARTICLE OF FOOTWEAR HAVING A FASTENING SYSTEM," the contents of which is incorporated herein by reference in its entirety.

REFERENCE REGARDING FEDERALLY SPONSORED RESEARCH OR DEVELOPMENT

Not applicable

SEQUENCE LISTING

Not applicable

BACKGROUND

1. Field of the Invention

The present disclosure relates generally to an article of footwear, and more specifically to articles of footwear having fastening mechanisms that include tensioning members and one or more tensioning elements.

2. Description of the Background

Many conventional shoes or other articles of footwear generally comprise an upper and a sole attached to a lower end of the upper. Conventional shoes further include an internal space, i.e., a void or cavity, which is created by interior surfaces of the upper and sole, that receives a foot of a user before securing the shoe to the foot. The sole is attached to a lower surface or boundary of the upper and is positioned between the upper and the ground. As a result, the sole typically provides stability and cushioning to the user when the shoe is being worn. In some instances, the sole may include multiple components, such as an outsole, a midsole, and a top portion. The outsole may provide traction to a bottom surface of the sole, and the midsole may be attached to an inner surface of the outsole and may provide cushioning or added stability to the sole. For example, a sole may include a particular foam material that may increase stability at one or more desired locations along the sole, or a foam material that may reduce stress or impact energy on the foot or leg when a user is running, walking, or engaged in another activity. The sole may also include additional components, such as plates, embedded with the sole to increase the overall stiffness of the sole and reduce energy loss during use.

The upper generally extends upward from the sole and defines an interior cavity that completely or partially encases a foot. In most cases, the upper extends over the instep and toe regions of the foot, and across medial and lateral sides thereof. Many articles of footwear may also include a tongue that extends across the instep region to bridge a gap between edges of medial and lateral sides of the upper, which define an opening into the cavity. The tongue may also be disposed below a lacing system and between medial and lateral sides of the upper, to allow for adjustment of shoe tightness. The tongue may further be manipulatable by a user to permit entry or exit of a foot from the internal space or cavity. In addition, a fastening mechanism may allow a user to adjust certain dimensions of the upper or the sole, thereby allowing the upper to accommodate a wide variety of foot types having varying sizes and shapes.

The upper of many shoes may comprise a wide variety of materials, which may be utilized to form the upper and chosen for use based on one or more intended uses of the shoe. The upper may also include portions comprising varying materials specific to a particular area of the upper. For example, added stability may be desirable at a front of the upper or adjacent a heel region so as to provide a higher degree of resistance or rigidity. In contrast, other portions of a shoe may include a soft woven textile to provide an area with stretch-resistance, flexibility, air-permeability, or moisture-wicking properties.

While many currently-available articles of footwear have varying features related to the above-noted properties, in many cases, footwear with fastening mechanisms that are more easily tightened and loosened by the user are desired, along with improved support of the user's foot along the upper of the footwear.

SUMMARY

An article of footwear, as described herein, may have various configurations. The article of footwear may have an upper and a sole structure connected to the upper.

In some embodiments, the present disclosure provides a fastening mechanism for an article of footwear, the fastening mechanism including a tensioning member having a member opening, a first tensioning element extending along a first side of an upper of the footwear, and a second tensioning element extending along a second side of the upper, opposite the first side. The first and the second tensioning elements are operatively coupled with the tensioning member about the member opening. The fastening mechanism is configured to be moveable between a loosened configuration, in which the first and the second tensioning elements are tensioned to a first tension, to a tightened configuration, in which the first and the second tensioning elements are tensioned to a second tension that is greater than the first tension, when the tensioning member is rotated relative to the article of footwear.

In some embodiments, the first tensioning element has a first end operatively coupled with the tensioning member and a second end attached to the first side of the footwear, and the second tensioning element has a first end operatively coupled with the tensioning member and a second end attached to the second side of the footwear. In some embodiments, the second ends of the first and the second tensioning elements are attached to a sole of the article of footwear. In other embodiments, the first tensioning element includes a plurality of first tensioning elements arranged on the first side of the footwear along a midfoot region and a heel region of the upper, and the second tensioning element includes a plurality of second tensioning elements arranged on the second side of the article of footwear along the midfoot region and the heel region of the upper.

In some embodiments, the tensioning member includes a first tensioning member with the member opening and a second tensioning member that is arranged within the member opening of the first tensioning member. In some embodiments, the first tensioning member is fixedly attached along an instep region of the upper, and the second tensioning member is configured to be rotatable within the member opening of the first tensioning member, and the fastening mechanism is configured to be moveable from the loosened configuration to the tightened configuration when the second tensioning member is rotated within the first tensioning member in a first direction. In some embodiments, the first tensioning member has a first aperture and a second aperture, which extend through outer and inner surfaces of the first tensioning member and into the member opening, the first tensioning element extends through the first aperture of the first tensioning member and the second tensioning element extends through the second aperture of the first tensioning member, and the first ends of the first and the second tensioning elements are attached to the second tensioning member. In some embodiments, the first tensioning member has a first elongated side and a second elongated side, opposite the first elongated side, and the second tensioning member is configured to be deformable such that an outer perimeter of the second tensioning member continuously contacts an inner perimeter of the first tensioning member, which defines the member opening, while the second tensioning member is rotated within the member opening of the first tensioning member. In some embodiments, the second tensioning member comprises an elastomeric material.

In some embodiments, the present disclosure provides an article of footwear including a sole attached to an upper and a fastening mechanism. The fastening mechanism includes a first tensioning member having a first member opening, a second tensioning member having a second member opening, and a tensioning element extending along the upper. The tensioning element is coupled with the first and the second tensioning members about the first and second member openings, respectively. The fastening mechanism is configured to be moveable between a loosened configuration, in which the tensioning element is tensioned to a first tension, to a tightened configuration, in which the tensioning element is tensioned to a second tension that is greater than the first tension, when at least one of the first and second tensioning members is rotated.

In some embodiments, the first and the second tensioning members are arranged along an instep region of the upper with the second tensioning member being rotatable relative to the first tensioning member within the first member opening, a first end of the tensioning element is fixedly attached to a first side of the footwear and a second end of the tensioning element is fixedly attached to a second side of the footwear, opposite the first side, and a segment of the tensioning element between the first and the second ends of the tensioning element is coupled with the first and the second tensioning members.

In some embodiments, the sole has a sole aperture extending through the sole from a first side of the sole to a second side of the sole, opposite the first side, and portions of the first and the second tensioning members are arranged within the sole aperture such that the first and the second tensioning members extend from the first side of the sole and over an instep region of the upper to the second side of the sole. In some embodiments, the first tensioning member is arranged toward a first end of the sole aperture, and the second tensioning member is arranged toward a second end of the sole aperture, opposite the first end. In some embodiments, a first end of the tensioning element is attached to the first tensioning member and a second end of the tensioning element is attached to the second tensioning member, and the fastening mechanism is configured to be moveable from the loosened configuration to the tightened configuration when the first tensioning member is rotated relative to the second tensioning member.

In some embodiments, the present disclosure provides a fastening mechanism for an article of footwear, the fastening mechanism including a first tensioning member having a first member opening, a second tensioning member having a second member opening, and a tensioning element extending along an instep region of an upper of the footwear. The tensioning element has a first end attached to the first tensioning member and a second end, opposite the first end, attached to the second tensioning member. The first and second member openings are configured to receive at least portions of the upper of the article of footwear. The fastening mechanism is configured to be moveable between a loosened configuration, in which the tensioning element is tensioned to a first tension, to a tightened configuration, in which the tensioning element is tensioned to a second tension that is greater than the first tension, when at least one of the first and second tensioning members is rotated.

In some embodiments, the fastening mechanism is configured to be moveable from the loosened configuration to the tightened configuration when the first tensioning member is rotated in a first direction relative to the second tensioning member. In some embodiments, the fastening mechanism is further configured to be moveable from the tightened configuration to a second tightened configuration when the second tensioning member is rotated in a second direction relative to the first tensioning member, the second direction being opposite the first direction, and, in the second tightened configuration, the tensioning element is tensioned to a third tension that is greater than the second tension.

In some embodiments, the fastening mechanism is configured to be moveable from the loosened configuration to the tightened configuration when the first tensioning member is rotated in a first direction and the second tensioning member is rotated in a second direction opposite the first direction.

In some embodiments, the tensioning element includes a plurality of tensioning elements, each of the plurality of tensioning elements having a first end attached along a perimeter of the first tensioning member and a second end attached along a perimeter of the second tensioning member. In some embodiments, when the fastening mechanism is in the loosened configuration, the plurality of tensioning elements are disposed parallel to each other.

Other aspects of the article of footwear, including features and advantages thereof, will become apparent to one of ordinary skill in the art upon examination of the figures and detailed description herein. Therefore, all such aspects of the article of footwear are intended to be included in the detailed description and this summary.

DETAILED DESCRIPTION OF THE DRAWINGS

Figure 1:
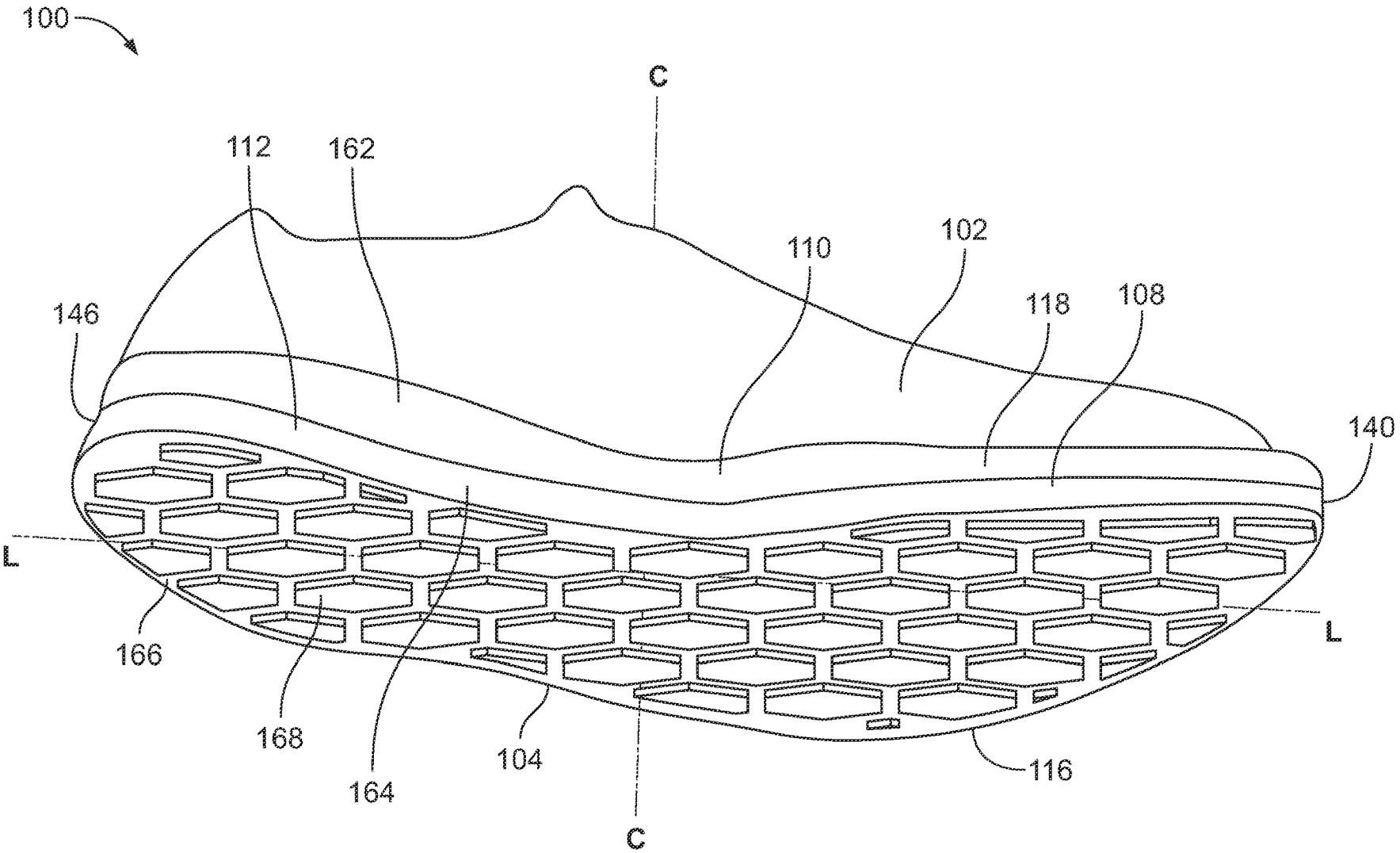
FIG. 1 is a perspective view of a bottom and medial side of an article of footwear configured as a left shoe that includes an upper and a sole structure, according to an embodiment of the disclosure.

The following discussion and accompanying figures disclose various embodiments or configurations of a shoe and a sole structure. Although embodiments of a shoe or sole structure are disclosed with reference to a sports shoe, such as a running shoe, tennis shoe, basketball shoe, etc., concepts associated with embodiments of the shoe or the sole structure may be applied to a wide range of footwear and footwear styles, including cross-training shoes, football shoes, golf shoes, hiking shoes, hiking boots, ski and snowboard boots, soccer shoes and cleats, walking shoes, and track cleats, for example. Concepts of the shoe or the sole structure may also be applied to articles of footwear that are considered non-athletic, including dress shoes, sandals, loafers, slippers, and heels. In addition to footwear, particular concepts described herein may also be applied and incorporated in other types of apparel or other athletic equipment, including helmets, padding or protective pads, shin guards, and gloves. Even further, particular concepts described herein may be incorporated in cushions, backpack straps, golf clubs, or other consumer or industrial products. Accordingly, concepts described herein may be utilized in a variety of products.

The term "about," as used herein, refers to variation in the numerical quantity that may occur, for example, through typical measuring and manufacturing procedures used for articles of footwear or other articles of manufacture that may include embodiments of the disclosure herein; through inadvertent error in these procedures; through differences in the manufacture, source, or purity of the ingredients used to make the compositions or mixtures or carry out the methods; and the like. Throughout the disclosure, the terms "about" and "approximately" refer to a range of values ±5% of the numeric value that the term precedes.

The term "elastomeric," as used herein, refers to elastic or rubber-like properties of a material, e.g., a polymer. For example, references to an "elastomeric material" are intended to refer to a material being configured to elastically deform when a load is applied to the material and to regain its original shape when the load is removed from the material.

As used herein, the term "diameter" refers to a shortest distance through a center of a perimeter or opening between opposing sides of the perimeter or opening. Thus, references to a "diameter" of a structure herein are not intended to imply a generally circular shape of a perimeter or opening of the component referred thereto. For example, reference to a "diameter" of an opening of a component having a non-circular shape can refer to the shortest distance through the center of the opening between opposing sides of the opening. Further, for example, reference to a "diameter" of an elastically deformable component can refer to a "first diameter" that corresponds to a non-elastically deformed circular shape of an opening of the component and to a "second diameter" that corresponds to an elastically deformed non-circular shape of the opening of the component. Still further, for example, reference to a "diameter" of an elastically deformable component can refer to a "first diameter" that corresponds to a non-elastically deformed non-circular shape of an opening of the component having a first shortest distance through a center of the opening between first opposing sides of the opening and to a "second diameter" and/or "third diameter" that corresponds to an elastically deformed, non-circular shape of the opening of the component having a second and/or third shortest distance through the center of the opening between second and/or third opposing sides of the opening that are different that the first opposing sides.

Further, as used herein, unless otherwise defined or limited, directional terms are used for convenience of reference for discussion of particular figures or examples. For example, references to "downward," or other directions, or "lower" or other positions, may be used to discuss aspects of a particular example or figure, but do not necessarily require similar orientation or geometry in all installations or configurations. The terms first, second, third, etc. may be used herein to describe various elements, components, regions, layers, and/or sections. These elements, components, regions, layers, and/or sections should not be limited by these terms. These terms may be only used to distinguish one element, component, region, layer, or section from another region, layer, or section. Terms such as "first," "second," and other numerical terms do not imply a sequence or order unless clearly indicated by the context. Thus, a first element, component, region, layer, or section discussed below could be termed a second element, component, region, layer, or section without departing from the teachings of the example configurations.

The present disclosure is directed to an article of footwear and/or specific components of the article of footwear, such as an upper and/or a sole or sole structure. The upper may comprise a knitted component, a woven textile, and/or a non-woven textile. The knitted component may be made by knitting of yarn, the woven textile by weaving of yarn, and the non-woven textile by manufacture of a unitary non-woven web. Knitted textiles include textiles formed by way of warp knitting, weft knitting, flat knitting, circular knitting, and/or other suitable knitting operations. The knit textile may have a plain knit structure, a mesh knit structure, and/or a rib knit structure, for example. Woven textiles include, but are not limited to, textiles formed by way of any of the numerous weave forms, such as plain weave, twill weave, satin weave, dobbin weave, jacquard weave, double weaves, and/or double cloth weaves, for example. Non-woven textiles include textiles made by air-laid and/or spun-laid methods, for example. The upper may comprise a variety of materials, such as a first yarn, a second yarn, and/or a third yarn, which may have varying properties or varying visual characteristics.

The following discussion and accompanying figures disclose various embodiments or configurations of an article of footwear. The article of footwear can be provided as a pair of shoes including a first or left shoe and a second or right shoe. The left and right shoes may be similar in all material aspects, except that the left shoe and the right shoe are sized and shaped to receive a left foot and a right foot of a user, respectively. For ease of disclosure, a single shoe or article of footwear will be referenced to describe aspects of the disclosure. In some figures, the article of footwear is depicted as a right shoe, and in some figures the article of footwear is depicted as a left shoe. The disclosure below with reference to the article of footwear is applicable to both the left shoe and the right shoe. In some embodiments, there may be differences between the left and right shoes other than the left/right configuration. For example, in some embodiments, the left shoe may include a fastening mechanism, while the right shoe may not include the fastening mechanism, or vice versa. Further, in some embodiments, the left shoe may include one or more additional elements that the right shoe does not include, or vice versa.

Figure 2:
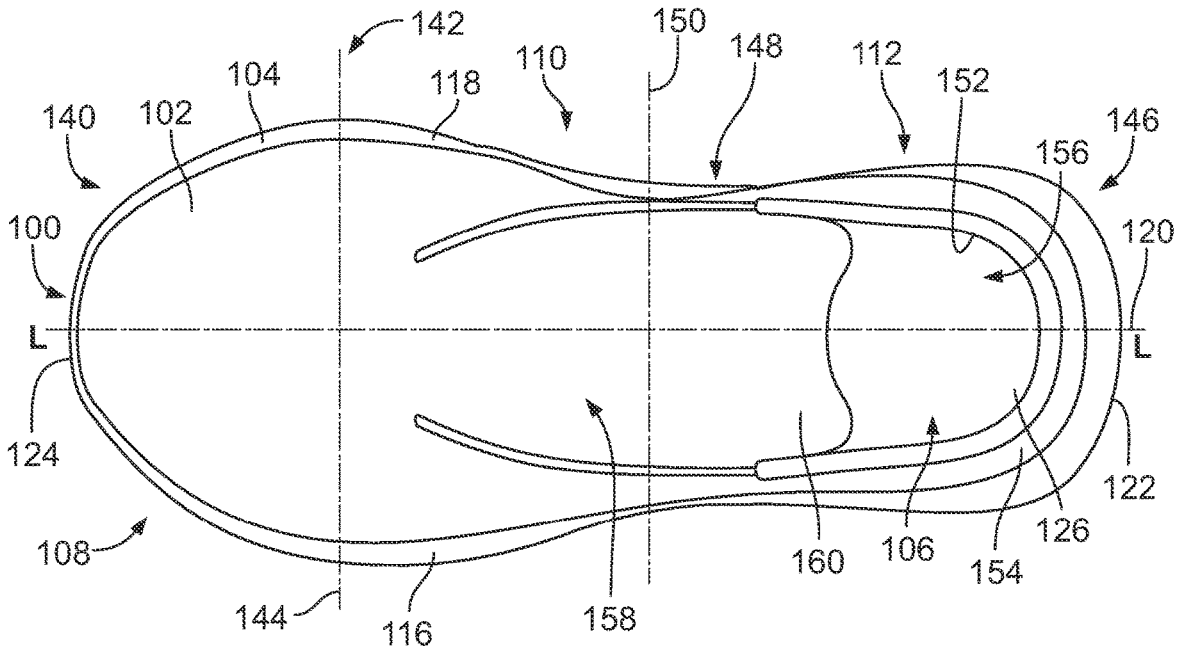
FIG. 2 is a top view of the article of footwear of FIG. 1.
Figure 3:
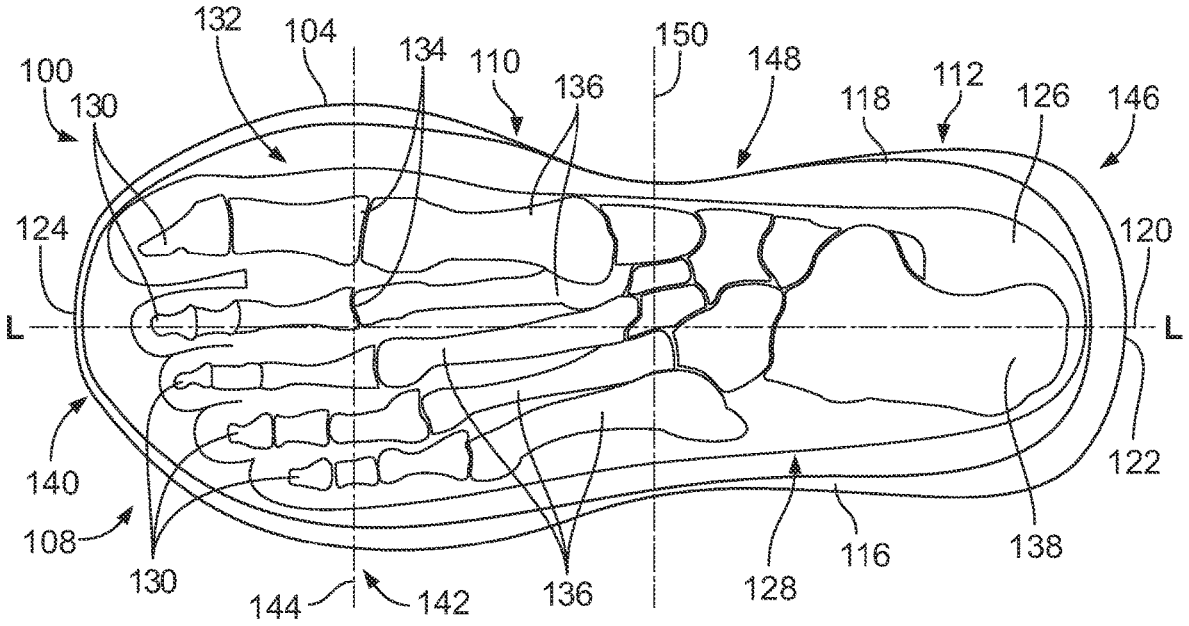
FIG. 3 is a top plan view of the article of footwear of FIG. 1 with an upper removed and a user's skeletal foot structure overlaid thereon.

Referring to FIGS. 1-3, an exemplary embodiment of an article of footwear 100 is shown, including an upper 102 and a sole structure 104. The upper 102 is attached to the sole structure 104 and together define an interior cavity 106 (see FIGS. 2 and 3) into which a foot of a user may be inserted. For reference, the article of footwear 100 defines a forefoot region 108, a midfoot region 110, and a heel region 112 (see FIGS. 2 and 3). The forefoot region 108 generally corresponds with portions of the article of footwear 100 that encase portions of the foot that includes the toes, the ball of the foot, and joints connecting the metatarsals with the toes or phalanges. The midfoot region 110 is proximate and adjoining the forefoot region 108, and generally corresponds with portions of the article of footwear 100 that encase the arch of the foot, along with the bridge of the foot. The heel region 112 is proximate and adjoining the midfoot region 110 and generally corresponds with portions of the article of footwear 100 that encase rear portions of the foot, including the heel or calcaneus bone, the ankle, and/or the Achilles tendon.

Many conventional footwear uppers are formed from multiple elements (e.g., textiles, polymer foam, polymer sheets, leather, and synthetic leather) that are joined through bonding or stitching at a seam. In some embodiments, the upper 102 of the article of footwear 100 is formed from a knitted structure or knitted components. In various embodiments, a knitted component may incorporate various types of yarn that may provide different properties to an upper. For example, one area of the upper 102 may be formed from a first type of yarn that imparts a first set of properties, and another area of the upper 102 may be formed from a second type of yarn that imparts a second set of properties. Using this configuration, properties of the upper 102 may vary throughout the upper 102 by selecting specific yarns for different areas of the upper 102.

With reference to the material(s) that comprise the upper 102, the specific properties that a particular type of yarn will impart to an area of a knitted component may at least partially depend upon the materials that form the various filaments and fibers of the yarn. For example, cotton may provide a soft effect, biodegradability, or a natural aesthetic to a knitted material. Elastane and stretch polyester may each provide a knitted component with a desired elasticity and recovery. Rayon may provide a high luster and moisture absorbent material, wool may provide a material with an increased moisture absorbance, nylon may be a durable material that is abrasion-resistant, and polyester may provide a hydrophobic, durable material.

Other aspects of a knitted component may also be varied to affect the properties of the knitted component and provide desired attributes. For example, a yarn forming a knitted component may include monofilament yarn or multifilament yarn, or the yarn may include filaments that are each formed of two or more different materials. In addition, a knitted component may be formed using a particular knitting process to impart an area of a knitted component with particular properties. Accordingly, both the materials forming the yarn and other aspects of the yarn may be selected to impart a variety of properties to particular areas of the upper 102.

In some embodiments, an elasticity of a knit structure may be measured based on comparing a width or length of the knit structure in a first, non-stretched state to a width or length of the knit structure in a second, stretched state after the knit structure has a force applied to the knit structure in a lateral direction. In further embodiments, the upper 102 may also include additional structural elements. For example, in some embodiments, a heel plate or cover (not shown) may be provided on the heel region 112 to provide added support to a heel of a user's foot. In some instances, other elements, e.g., plastic material, logos, trademarks, etc., may also be applied and fixed to an exterior surface using glue or a thermoforming process. In some embodiments, the properties associated with the upper 102, e.g., a stitch type, a yarn type, or characteristics associated with different stitch types or yarn types, such as elasticity, aesthetic appearance, thickness, air permeability, or scuff-resistance, may be varied.

Referring again to FIG. 1, the sole structure 104 is connected or secured to the upper 102 and extends between a foot of a user and the ground when the article of footwear 100 is worn by the user. The sole structure 104 may include one or more components, which may include an outsole, a midsole, a heel, a vamp, and/or an insole. For example, in some embodiments, a sole structure may include an outsole that provides structural integrity to the sole structure, along with providing traction for a user, a midsole that provides a cushioning system, and an insole that provides support for an arch of a user's foot. In addition, the insole may be a strobel board, a forefoot board, a lasting board, etc., or a combination thereof, and the insole may be provided between the upper 102 and the sole structure 104, or the insole may be provided as part of the upper 102.

Furthermore, the insole can be positioned within the interior cavity of the upper 102, which can be in direct contact with a user's foot while the article of footwear 100 is being worn. Moreover, the upper 102 may also include a liner (not shown) that can increase comfort, for example, by reducing friction between the foot of the user and the upper 102, the sole structure 104, an insole, or the like, and/or by providing moisture wicking properties. The liner may line the entirety of an interior cavity of the upper 102 or only a portion thereof. In some embodiments, a binding (not shown) may surround an opening of the interior cavity of the upper 102 to secure the liner to the upper 102 and/or to provide an aesthetic element on the article of footwear 100.

Referring to FIGS. 2 and 3, the article of footwear 100 also defines a lateral side 116 and a medial side 118. When a user is wearing the shoes, the lateral side 116 corresponds with an outside-facing portion of the article of footwear 100 while the medial side 118 corresponds with an inside-facing portion of the article of footwear 100. As such, the article of footwear 100 has opposing lateral and medial sides 116, 118. The lateral and medial sides 116, 118 adjoin one another along a longitudinal central plane or axis 120 of the article of footwear 100, which is coplanar with the longitudinal axis L of FIG. 1. As will be further discussed herein, the longitudinal central plane or axis 120 may demarcate a central, intermediate axis between the lateral and medial sides 116, 118 of the article of footwear 100. Put differently, the longitudinal plane or axis 120 may extend between a rear, proximal end 122 of the article of footwear 100 and a front, distal end 124 of the article of footwear 100 and may continuously define a middle of an insole 126, the sole structure 104, and/or the upper 102 of the article of footwear 100, i.e., the longitudinal plane or axis 120 is a straight axis extending through the proximal end 122 of the heel region 112 to the distal end 124 of the forefoot region 108.

Unless otherwise specified, and referring to FIGS. 2 and 3, the article of footwear 100 may be defined by the forefoot, midfoot, and heel regions 108, 110, 112. The forefoot region 108 may generally correspond with portions of the article of footwear 100 that encase portions of a foot 128 of a user that include the toes or phalanges 130, the ball 132 of the foot 128, and one or more of the joints 134 that connect the metatarsals 136 of the foot 128 with the toes or phalanges 130. The midfoot region 110 is proximate and adjoins the forefoot region 108. The midfoot region 110 generally corresponds with portions of the article of footwear 100 that encase an arch of the foot 128, along with a bridge of the foot 128. The heel region 112 is proximate to the midfoot region 110 and adjoins the midfoot region 110. The heel region 112 generally corresponds with portions of the article of footwear 100 that encase rear portions of the foot 128, including the heel or calcaneus bone 138, the ankle (not shown), and/or the Achilles tendon (not shown).

Still referring to FIGS. 2 and 3, the forefoot region 108, the midfoot region 110, the heel region 112, the lateral side 116, and the medial side 118 are intended to define boundaries or areas of the article of footwear 100. To that end, the forefoot region 108, the midfoot region 110, the heel region 112, the lateral side 116, and the medial side 118 generally characterize sections of the article of footwear 100. Certain aspects of the disclosure may refer to portions or elements that are coextensive with one or more of the forefoot region 108, the midfoot region 110, the heel region 112, the lateral side 116, and/or the medial side 118. Further, both the upper 102 and the sole structure 104 may be characterized as having portions within the forefoot region 108, the midfoot region 110, the heel region 112, and/or along the lateral side 116 and/or the medial side 118. Therefore, the upper 102 and the sole structure 104, and/or individual portions of the upper 102 and the sole structure 104, may include portions thereof that are disposed within the forefoot region 108, the midfoot region 110, the heel region 112, and/or along the lateral side 116 and/or the medial side 118.

Still referring to FIGS. 2 and 3, the forefoot region 108, the midfoot region 110, the heel region 112, the lateral side 116, and the medial side 118 are shown in detail. The forefoot region 108 extends from a toe end 140 to a widest portion 142 of the article of footwear 100. The widest portion 142 is defined or measured along a first line 144 that is perpendicular with respect to the longitudinal axis 120 that extends from a distal portion of the toe end 140 to a distal portion of a heel end 146, which is opposite the toe end 140. The midfoot region 110 extends from the widest portion 142 to a thinnest portion 148 of the article of footwear 100. The thinnest portion 148 of the article of footwear 100 is defined as the thinnest portion of the article of footwear 100 measured across a second line 150 that is perpendicular with respect to the longitudinal axis 120. The heel region 112 extends from the thinnest portion 148 to the heel end 146 of the article of footwear 100.

It should be understood that numerous modifications may be apparent to those skilled in the art in view of the foregoing description, and individual components thereof, may be incorporated into numerous articles of footwear. Accordingly, aspects of the article of footwear 100 and components thereof, may be described with reference to general areas or portions of the article of footwear 100, with an understanding the boundaries of the forefoot region 108, the midfoot region 110, the heel region 112, the lateral side 116, and/or the medial side 118 as described herein may vary between articles of footwear. However, aspects of the article of footwear 100 and individual components thereof, may also be described with reference to exact areas or portions of the article of footwear 100 and the scope of the appended claims herein may incorporate the limitations associated with these boundaries of the forefoot region 108, the midfoot region 110, the heel region 112, the lateral side 116, and/or the medial side 118 discussed herein.

Still referring to FIGS. 2 and 3, the medial side 118 begins at the distal, toe end 140 and bows outward along an inner side of the article of footwear 100 along the forefoot region 108 toward the midfoot region 110. The medial side 118 reaches the first line 144, at which point the medial side 118 bows inward, toward the central, longitudinal axis 120. The medial side 118 extends from the first line 144, i.e., the widest portion 142, toward the second line 150, i.e., the thinnest portion 148, at which point the medial side 118 enters into the midfoot region 110, i.e., upon crossing the first line 144. Once reaching the second line 150, the medial side 118 bows outward, away from the longitudinal, central axis 120, at which point the medial side 118 extends into the heel region 112, i.e., upon crossing the second line 150. The medial side 118 then bows outward and then inward toward the heel end 146, and terminates at a point where the medial side 118 meets the longitudinal, central axis 120.

The lateral side 116 also begins at the distal, toe end 140 and bows outward along an outer side of the article of footwear 100 along the forefoot region 108 toward the midfoot region 110. The lateral side 116 reaches the first line 144, at which point the lateral side 116 bows inward, toward the longitudinal, central axis 120. The lateral side 116 extends from the first line 144, i.e., the widest portion 142, toward the second line 150, i.e., the thinnest portion 148, at which point the lateral side 116 enters into the midfoot region 110, i.e., upon crossing the first line 144. Once reaching the second line 150, the lateral side 116 bows outward, away from the longitudinal, central axis 120, at which point the lateral side 116 extends into the heel region 112, i.e., upon crossing the second line 150. The lateral side 116 then bows outward and then inward toward the heel end 146, and terminates at a point where the lateral side 116 meets the longitudinal, central axis 120.

Still referring to FIGS. 2 and 3, the upper 102 extends along the lateral side 116 and the medial side 118, and across the forefoot region 108, the midfoot region 110, and the heel region 112 to house and enclose a foot of a user. When fully assembled, the upper 102 also includes an interior surface 152 and an exterior surface 154. The interior surface 152 faces inward and generally defines the interior cavity 106, and the exterior surface 154 of the upper 102 faces outward and generally defines an outer perimeter or boundary of the upper 102. The upper 102 also includes an opening 156 that is at least partially located in the heel region 112 of the article of footwear 100, which provides access to the interior cavity 106 and through which a foot of a user may be inserted and removed. In some embodiments, the upper 102 may also include an instep region 158 that extends from the opening 156 in the heel region 112 over an area corresponding to an instep of a foot of a user to an area proximate the forefoot region 108. The instep region 158 may comprise an area similar to where a tongue 160 of the present embodiment is disposed. In some embodiments, the upper 102 does not include the tongue 160, i.e., the upper 102 is tongueless.

In the illustrated embodiment, the sole structure 104 includes a midsole 162 and an outsole 164. The outsole 164 may define a bottom end or surface 166 of the sole structure 104 across the forefoot, midfoot, and heel regions 108, 110, 112. Further, the outsole 164 may be a ground-engaging portion, or include a ground-engaging surface, of the sole structure 104 and may be opposite of the insole 126 (see FIG. 2) thereof. As illustrated in FIG. 1, the bottom surface 166 of the outsole 164 may include a tread pattern 168 that can include a variety of shapes and configurations. The outsole 164 may be formed from one or more materials to impart durability, wear-resistance, abrasion resistance, or traction to the sole structure 104. In some embodiments, the outsole 164 may be formed from any kind of elastomeric material, e.g., rubber, including thermoset elastomers or thermoplastic elastomers, or a thermoplastic material, e.g., thermoplastic polyurethane (TPU). In some embodiments, the outsole 164 may define a shore A hardness up to 95. In addition, the outsole 164 may be manufactured by a process involving injection molding, vulcanization, printing layer by layer, i.e., additive manufacturing systems or methods, and the like.

Still referring to FIG. 1, the midsole 162 may be individually constructed from a thermoplastic material, such as polyurethane (PU), for example, and/or an ethylene-vinyl acetate (EVA), copolymers thereof, or a similar type of material. In other embodiments, the midsole 162 may be an EVA-Solid-Sponge ("ESS") material, an EVA foam (e.g., PUMA® ProFoam Lite™, IGNITE Foam), polyurethane, polyether, an olefin block copolymer, organosheets, a thermoplastic material (e.g., a thermoplastic polyurethane, a thermoplastic elastomer, a thermoplastic polyolefin, etc.), or a supercritical foam. The midsole 162 may be a single polymeric material or may be a blend of materials, such as an EVA copolymer, a thermoplastic polyurethane, a polyether block amide (PEBA) copolymer, and/or an olefin block copolymer. One example of a PEBA material is PEBAX®. In some embodiments, the midsole 162 is manufactured by a process involving injection molding, vulcanization, printing layer by layer, i.e., additive manufacturing systems or methods, and the like.

In embodiments where the midsole 162 is formed from a supercritical foaming process, the supercritical foam may comprise micropore foams or particle foams, such as a TPU, EVA, PEBAX®, or mixtures thereof, manufactured using a process that is performed within an autoclave, an injection molding apparatus, or any sufficiently heated/pressurized container that can process the mixing of a supercritical fluid (e.g., CO2, N2, or mixtures thereof) with a material (e.g., TPU, EVA, polyolefin elastomer, or mixtures thereof) that is preferably molten. During an exemplary process, a solution of supercritical fluid and molten material is pumped into a pressurized container, after which the pressure within the container is released, such that the molecules of the supercritical fluid rapidly convert to gas to form small pockets within the material and cause the material to expand into a foam. In further embodiments, the midsole 162 may be formed using alternative methods known in the art, including the use of an expansion press, an injection machine, a pellet expansion process, a cold foaming process, a compression molding technique, die cutting, or any combination thereof. For example, the midsole 162 may be formed using a process that involves an initial foaming step in which supercritical gas is used to foam a material and then compression molded or die cut to a particular shape.

Figure 4:
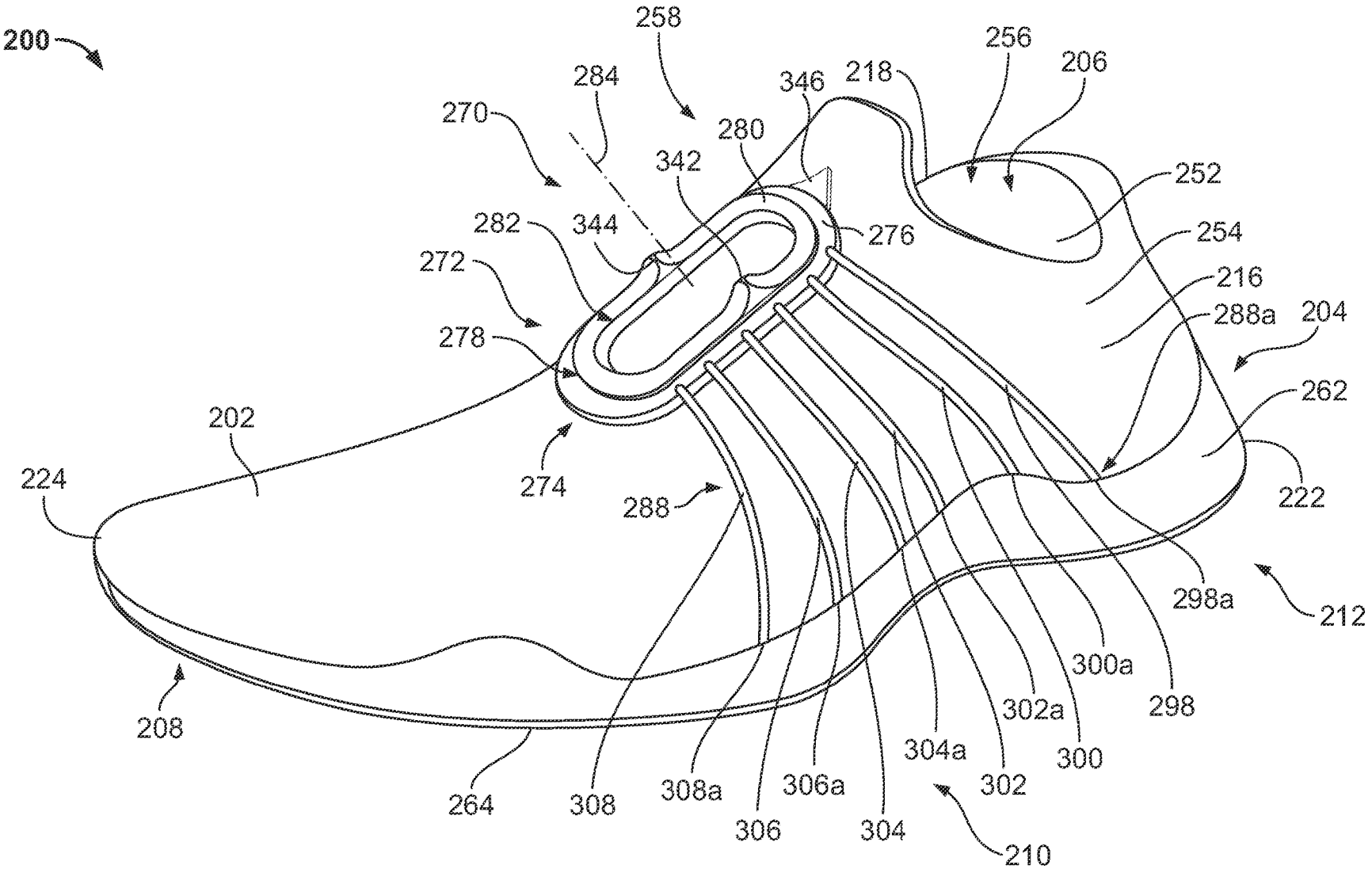
FIG. 4 is a perspective view of a lateral and a toe side of an article of footwear configured as a left shoe with a fastening mechanism in a loosened configuration, according to an embodiment of the disclosure.

Now referring to FIG. 4, an exemplary article of footwear 200 is shown, which includes a fastening mechanism 270 having a ring or tensioning member 272 that is operably engaged or coupled with a wire or tensioning element 274 to tighten and/or loosen at least the upper 202 the article of footwear 200 around a user's foot. The article of footwear 200 is similar to the previous embodiment, with like elements being indicated by similar reference numerals under the "2xx" series and the "3xx" series of reference numerals. For example, the article of footwear 200 includes the upper 202 that defines an opening 256 into an interior cavity 206 therein and a sole structure 204 that includes a midsole 262 and an outsole 264, just as the article of footwear 100 includes the upper 102 and the sole structure 104.

In the illustrated embodiment of FIG. 4, the tensioning member 272 of the article of footwear 200 includes a first or outer tensioning member 276 having a first or outer member opening 278 and a second or inner tensioning member 280 having a second or inner member opening 282. The inner tensioning member 280 is arranged within the outer member opening 278 of the outer tensioning member 276, such that a first or outer central axis of the outer tensioning member 276 and a second or inner central axis of the inner tensioning member 280 are aligned and parallel, i.e., coaxial, about a tensioning member axis 284. In other words, the outer tensioning member 276 is a first or outer ring and the inner tensioning member 280 is a second or inner ring arranged within the outer ring. In some embodiments, the inner tensioning member 280 may not include the inner member opening 282. In the illustrated embodiment, the tensioning member 272, i.e., the outer and inner tensioning members 276, 280, is disposed on or along the instep region 258 of the upper 202 of the footwear 200 and at least partially within each of the midfoot and heel regions 210, 212. In some embodiments, the tensioning member 272 can be disposed on or along the instep region 258 adjacent to the opening 256 of the upper 202. In some embodiments, the tensioning member 272 is disposed entirely within the midfoot region 210. In some embodiments, the tensioning member 272 is disposed at least partially within the forefoot region 208. In some embodiments, the tensioning member 272 can be disposed on or along a tongue (not shown) of the upper 202, such as, e.g., on the tongue 160 (see FIG. 2) of the article of footwear 100.

Still referring to FIG. 4, the tensioning element 274 of the fastening mechanism 270 is generally configured to be tensioned by the tensioning member 272 to tighten or loosen the fastening mechanism 270 about the upper 202. In the illustrated embodiment, the tensioning element 274 includes a first or lateral tensioning element 288 and a second or medial tensioning element 290 (see FIGS. 5 and 6). The lateral tensioning element 288 extends along the lateral side 216 of the upper 202 from the sole structure 204, such as, e.g., the midsole 262 thereof, to a first or lateral side 292 of the outer tensioning member 276, and the medial tensioning element 290 extends along the medial side 218 of the upper 202 from the sole structure 204, such as, e.g., the midsole 262 thereof, to a second or medial side 294 of the outer tensioning member 276. In some embodiments, the fastening mechanism 270 can include three or more tensioning elements 274. For example, in some embodiments, the fastening mechanism 270 can further include a third or distal tensioning element (not shown) extending along the instep region 258 of the upper 202 from the distal end 224 of the sole structure 204 to the outer tensioning member 276 and/or a fourth or proximal tensioning element (not shown) extending along the lateral and/or medial sides 216, 218 of the upper 202 from the proximal end 222 of the sole structure 204 to the outer tensioning member 276.

With continued reference to FIG. 4, in the illustrated embodiment, the lateral tensioning element 288 includes a first lateral tensioning element 298 arranged toward the proximal end 222 of the article of footwear 200, a second lateral tensioning element 300 arranged adjacent to the first lateral tensioning element 298, a third lateral tensioning element 302 arranged adjacent to the second lateral tensioning element 300, a fourth lateral tensioning element 304 arranged adjacent to the third lateral tensioning element 302, a fifth lateral tensioning element 306 arranged adjacent to the fourth lateral tensioning element 304, and a sixth lateral tensioning element 308 arranged adjacent to the fifth lateral tensioning element 306 and toward the distal end 224 of the article of footwear 200. In other words, the lateral tensioning elements 298, 300, 302, 304, 306, 308 are arranged in series along the lateral side 216 of the upper 202 with the first lateral tensioning element 298 being nearest the proximal end 222 and the sixth lateral tensioning element 306 being nearest the distal end 224. In the illustrated embodiment, one or more of the lateral tensioning elements 298, 300, 302, 304, 306, 308 are disposed in each of the forefoot, midfoot, and heel regions 208, 210, 212 of the article of footwear 200. In some embodiments, the lateral tensioning elements 298, 300, 302, 304, 306, 308 can be disposed entirely in the midfoot region 210 of the article of footwear 200.

Figure 6:
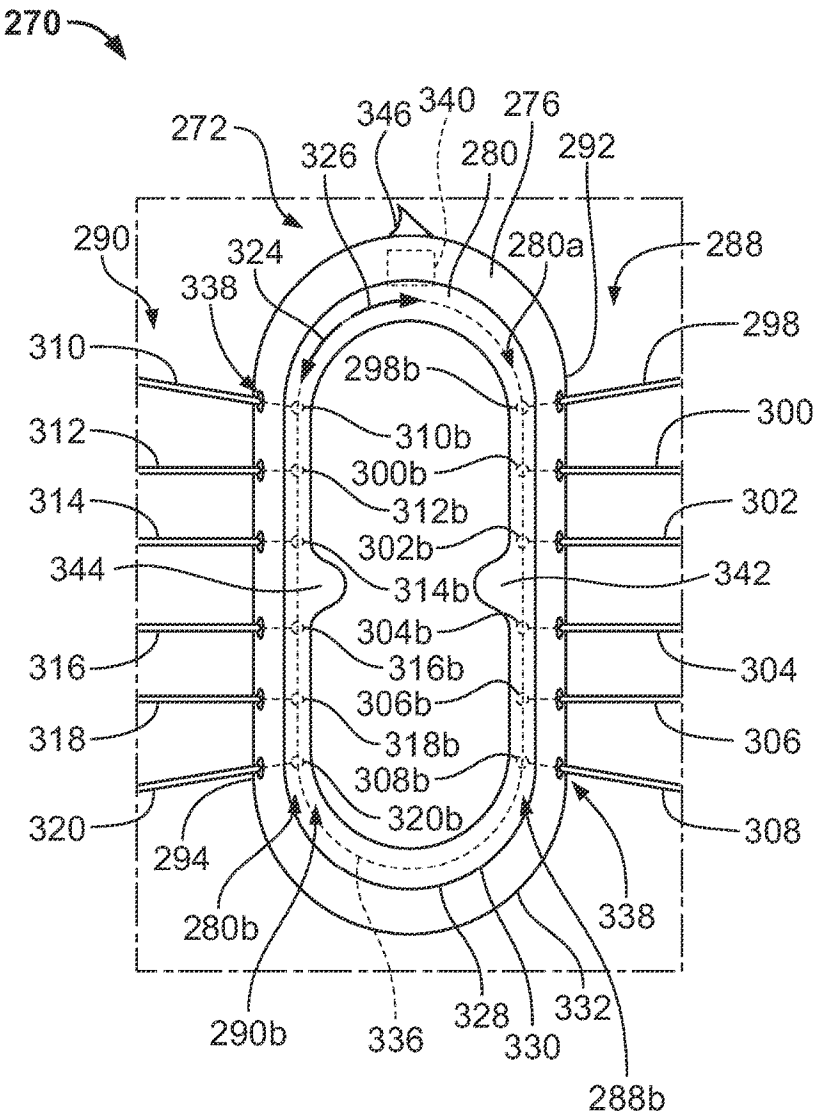
FIG. 6 is a top detail view of the fastening mechanism of FIG. 4 in the loosened configuration.

Referring to FIG. 6, the medial tensioning element 290 includes a first medial tensioning element 310 arranged toward the proximal end 222 (see FIG. 4) of the article of footwear 200, a second medial tensioning element 312 arranged adjacent to the first medial tensioning element 310, a third medial tensioning element 314 arranged adjacent to the second medial tensioning element 312, a fourth medial tensioning element 316 arranged adjacent to the third medial tensioning element 314, a fifth medial tensioning element 318 arranged adjacent to the fourth medial tensioning element 316, and a sixth medial tensioning element 320 arranged adjacent to the fifth medial tensioning element 318 and toward the distal end 224 (see FIG. 4) of the article of footwear 200. In other words, similar to the lateral tensioning elements 298, 300, 302, 304, 306, 308, the medial tensioning elements 310, 312, 314, 316, 318, 320 are arranged in series along the medial side 218 of the upper 202 with the first medial tensioning element 310 being nearest the proximal end 222 and the sixth medial tensioning element 294 being nearest the distal end 224 (see FIG. 4). In the illustrated embodiment, and similar to the lateral tensioning elements 298, 300, 302, 304, 306, 308, one or more of the medial tensioning elements 310, 312, 314, 316, 318, 320 are disposed in each of the forefoot, midfoot, and heel regions 208, 210, 212 of the article of footwear 200 (see FIG. 4). In some embodiments, the medial tensioning elements 310, 312, 314, 316, 318, 320 can be disposed entirely in the midfoot region 210 of the article of footwear 200 (see FIG. 4).

Figure 5:
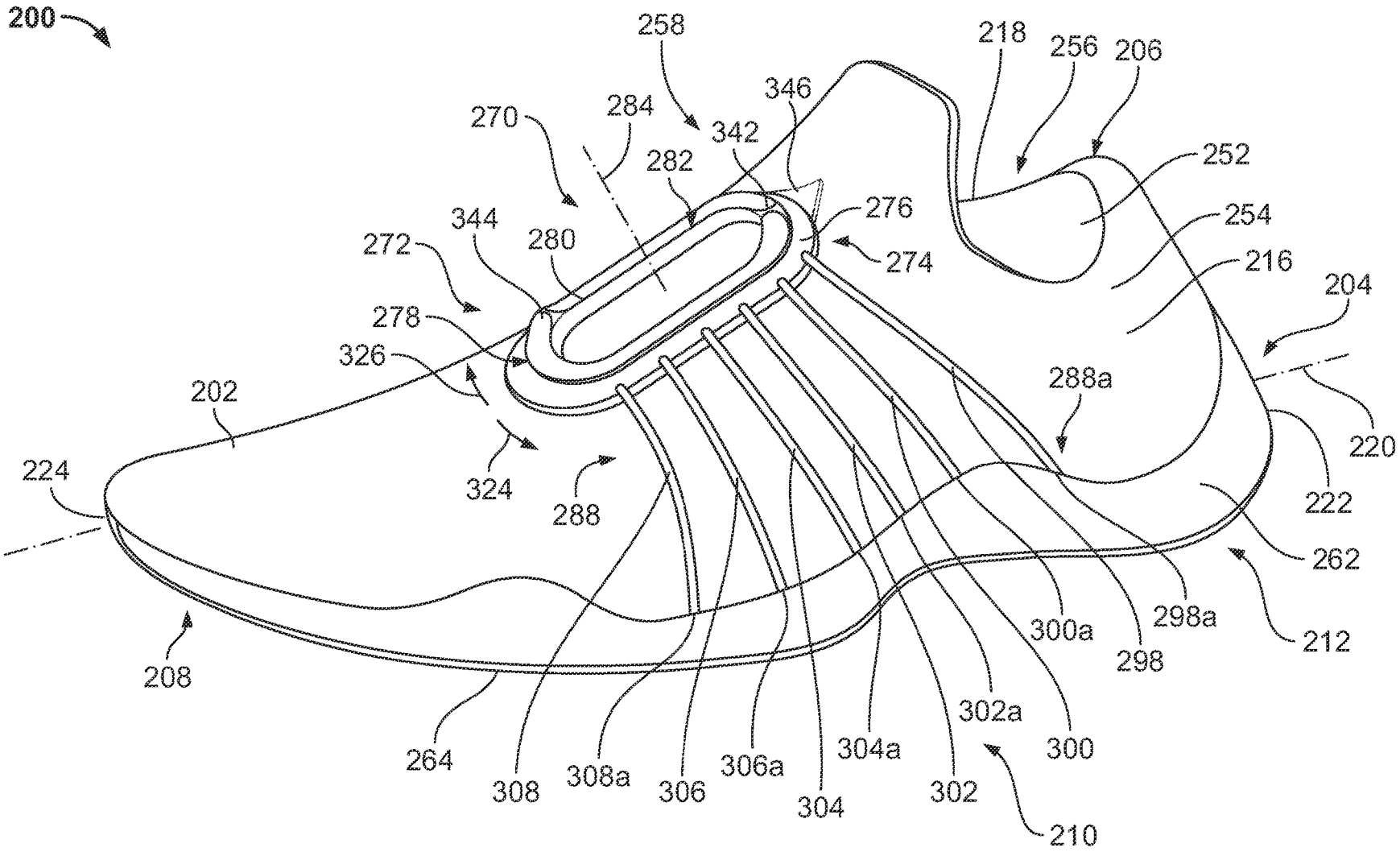
FIG. 5 is a perspective view of a lateral and a toe side of the article of footwear of FIG. 4 with the fastening mechanism in a tightened configuration.

Referring to FIGS. 4 and 5, the fastening mechanism 270 is configured to be moveable between an initial or loosened configuration (shown in FIGS. 4 and 6), in which the tensioning element 274 (i.e., the lateral and medial tensioning elements 288, 290) is tensioned to a first tension, and a tightened configuration (shown in FIGS. 5 and 7), in which the tensioning element 274 (i.e., one or both of the lateral and medial tensioning elements 288, 290) is tensioned to a second tension that is greater than the first tension, via rotation of the inner tensioning member 280 relative to the outer tensioning member 276. It should be understood that the first and second tensions are intended to refer to tension amounts or magnitudes, which can include no tension amount or magnitude, and that references to a particular tension, i.e., the first and second tensions, refer to a tensile force applied by the tensioning member 272 to the tensioning element 274, which can include no tensile force. In particular, in the illustrated embodiment, the outer tensioning member 276 is fixedly attached to the upper 202 and the inner tensioning member 280 is configured to be rotatable within the outer tensioning member 276 about the tensioning member axis 284 in both a first direction 324 and in a second direction 326, opposite the first direction 324. The outer and inner tensioning members 276, 280 are configured such that an outer perimeter 328 of the inner tensioning member 280 continuously contacts an inner perimeter 330 of the outer tensioning member 276, opposite an outer perimeter 332 of the outer tensioning member 276, while the inner tensioning member 280 is rotated.

Still referring to FIGS. 4 and 5, first ends 298*a*, 300*a*. 302*a*, 304*a*, 306*a*, 308*a* of the lateral tensioning elements 298, 300, 302, 304, 306, 308, respectively, (collectively referred to as first end 288*a* of the lateral tensioning element 288) are fixedly attached to the sole structure 204 and the lateral tensioning elements 298, 300, 302, 304, 306, 308 extend toward the lateral side 292 of the outer tensioning member 276 along the lateral side 216 of the upper 202. Similarly, first ends 310*a*, 312*a*. 314*a*, 316*a*, 318*a*, 320*a* (not shown) of the medial tensioning elements 310, 312, 314, 316, 318, 320, respectively, (collectively referred to as first end 290*a* of the medial tensioning element 290) are fixedly attached to the sole structure 204 and the medial tensioning elements 310, 312, 314, 316, 318, 320 extend toward the medial side 294 of the outer tensioning member 276 along the medial side 218 of the upper 202. In some embodiments, the upper 202 can define one or more tensioning element receivers (not shown) that is configured to receive at least a portion of one or more of the medial or lateral tensioning elements 288, 290 between the first ends 288*a*, 290*a* and the outer tensioning member 276. For example, in some embodiments, the upper 202 can include a first or inner layer (not shown) that at least partially defines the interior surface 252 of the upper 202 and a second or outer layer (not shown) that at least partially defines the exterior surface 254 of the upper 202 and one or both of the lateral and medial tensioning elements 288, 290 can extend at least partially between the inner and outer layers of the upper 202. In some embodiments, the article of footwear 200 can be configured such that the first ends 288*a*, 290*a* of the lateral and medial tensioning elements 288, 290 can be slidably moveable along the sole structure 204 between the proximal and distal ends 222, 224. In some embodiments, the tensioning element 274 can include one or more tensioning elements that extend from the lateral side 292 of the outer tensioning member 276 and along the lateral side 216 of the upper 202 and around the upper 202 between the sole structure 204 to the medial side 218 of the upper 202 to the medial side 294 of the outer tensioning member 276.

Figure 7:
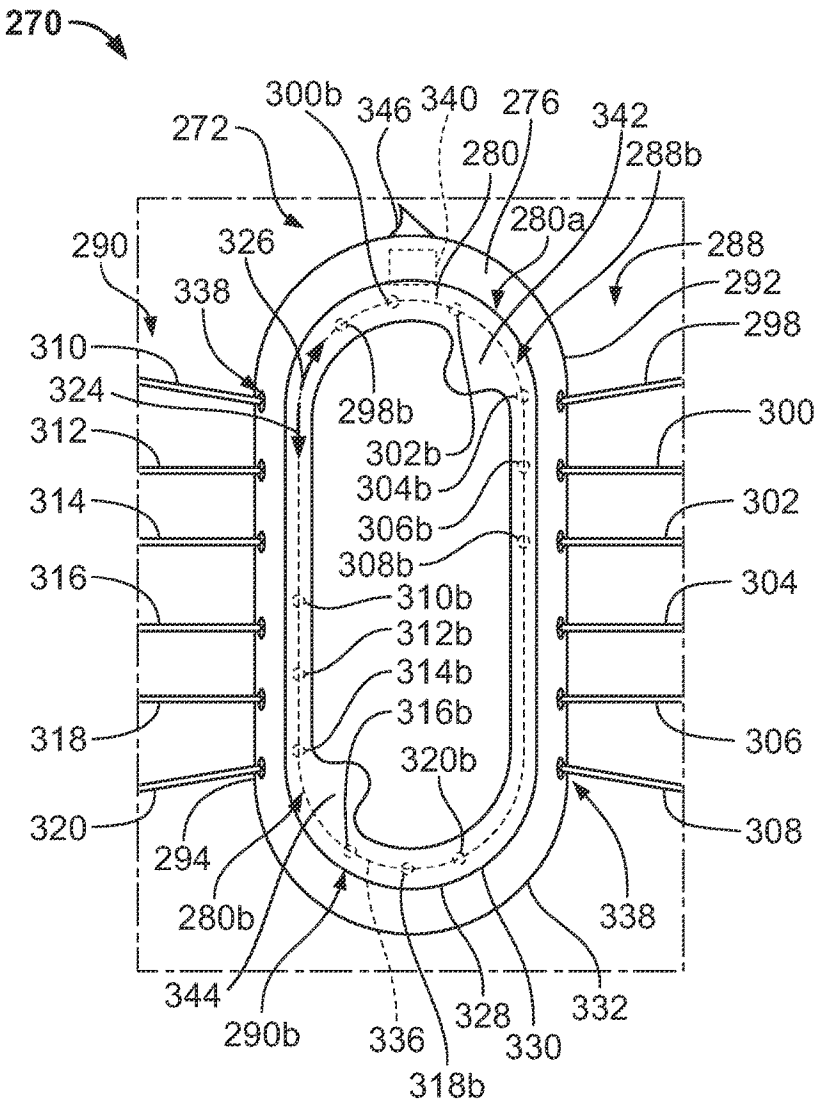
FIG. 7 is a top detail view of the fastening mechanism of FIG. 4 in the tightened configuration.

Referring now FIGS. 6 and 7, in the illustrated embodiment, the outer tensioning member 276 has a non-circular shape with the lateral and medial sides 292, 294 being generally straight and parallel with respect to one another while the sides connecting the lateral and medial sides 292, 294 are curved, i.e., an elliptical or oval shape. In other words, the lateral and medial sides 292, 294 are elongated relative to the sides of the outer tensioning member 276 that connect the lateral and medial sides 292, 294. As such, the inner tensioning member 280 can be configured such that at least a portion of the inner tensioning member 280 is elastically deformable and, thus, adaptable to the fixed shape of the inner perimeter 330 of the outer tensioning member 276 as the inner tensioning member 280 is rotated therein. For example, in some embodiments, the outer tensioning member 276 may comprise a first material, and the inner tensioning member 280 may comprise a second material having different properties than the first material. In some embodiments, the outer tensioning member 276 may comprise a rigid material while the inner tensioning member 280 may comprise an elastomeric or flexible material. In some embodiments, the outer perimeter 332 of the outer tensioning member 276 has a shape that is different than a shape of the inner perimeter 330 of the outer tensioning member 276. For example, in some embodiments, the outer perimeter 332 of the outer tensioning member 276 can have a rectangular or square shape with the inner perimeter 330 having a circular or ellipsoidal shape. In some embodiments, at least the inner perimeter 330 of the outer tensioning member 276 has a generally circular shape and, thus, the outer perimeter 328 of the inner tensioning member 280 has a generally circular shape. In some embodiments, at least the inner perimeter 330 of the outer tensioning member 276 can have a regular or irregular polygonal shape, such as, for example, a triangular shape, a quadrilateral shape, a pentagonal shape, a hexagonal shape, or an octagonal shape. In such embodiments, the inner tensioning member 280 can have a shape that is the same or that is different than the shape of the outer tensioning member 276. In some embodiments, the elongated sides 292, 294 of the outer tensioning member 276 can extend in directions that are substantially parallel to a longitudinal central plane or axis 220 (see FIG. 5) of the article of footwear 200.

Referring specifically to FIG. 6, the inner tensioning member 280 includes a channel 336, shown in phantom lines, that is disposed along the outer perimeter 328 of the inner tensioning member 280. The channel 336 is configured to receive portions of the lateral and medial tensioning elements 288, 290 when the fastening mechanism 270 is in the tightened configuration. The channel 336 of the inner tensioning member 280 has an outwardly facing open side (not shown), such that an inner perimeter 330 of the outer tensioning member 276 at least partially closes the channel 336 when the inner tensioning member 280 is arranged within the inner perimeter 330 of the outer tensioning member 276. Second ends 298*b*, 300*b*, 302*b*, 304*b*, 306*b*, 308*b* of the first, second, third, fourth, fifth, and sixth lateral tensioning elements 298, 300, 302, 304, 306, 308, respectively, (collectively referred to as second end 288*b* of the lateral tensioning element 288) extend through corresponding apertures 338 disposed on the lateral side 292 of the outer tensioning member 276 and are fixedly attached within the channel 336 along a first or lateral portion 280*a* of the inner tensioning member 280. Similarly, second ends 310*b*, 312*b*, 314*b*, 316*b*, 318*b*, 320*b* of the first, second, third, fourth, fifth, and sixth medial tensioning elements 310, 312, 314, 316, 318, 320, respectively, (collectively referred to as second end 290*b* of the medial tensioning element 290) extend through corresponding apertures 338 disposed on the medial side 294 of the outer tensioning member 276 and are fixedly attached within the channel 336 along a second or medial portion 280*b* of the inner tensioning member 280, opposite the lateral portion 280*a*.

Referring to FIG. 7, when the inner tensioning member 280 is rotated within the inner perimeter 330 of the outer tensioning member 276 in the first direction 324, the fixedly attached second ends 288*b*, 290*b* of the lateral and medial tensioning elements 288, 290 move with the inner tensioning member 280 in the first direction 324. Thus, rotation of the inner tensioning member 280 in the first direction 324 causes the lateral and medial tensioning elements 288, 290 to be pulled simultaneously into the apertures 338 of the outer tensioning member 276 with portions of the lateral and medial tensioning elements 288, 290 adjacent to the second ends 288*b*, 290*b* wrapping around or spooled within the channel 336 of the inner tensioning member 280 (for illustration purposes, FIG. 7 depicts only the location of the second ends 288*b*, 290*b* of the lateral and medial tensioning elements 288, 290) while the first ends 288*a*, 290*a* of the lateral and medial tensioning elements 288, 290 remain fixed to the sole structure 204. In some embodiments, at least a portion of the outer tensioning member 276 and/or the inner tensioning member 280 may comprise a translucent or transparent material such that the portions of the lateral and medial tensioning elements 288, 290 spooled within the channel 336 are visible from an exterior of the article of footwear 200. In some embodiments, the channel 336 or a second channel (not shown) can be defined along the inner perimeter 330 of the outer tensioning member 276. In some embodiments, the inner tensioning member 280, and thus also the second ends 288*b*, 290*b* of the lateral and medial tensioning elements 288, 290, can be fixedly attached to the upper 202 and the outer tensioning member 276 can be rotatable relative to the inner tensioning member 280. As mentioned above, in some embodiments, the inner tensioning member 280 may not include the inner member opening 282, and, in such embodiments, the inner tensioning member 280 may be rotatably attached to the upper 202 and rotatable relative to the outer tensioning member 276 about the tensioning member axis 284 (see FIG. 5).

As shown in FIG. 7 and as a result of portions of the lateral and medial tensioning elements 288, 290 being spooled around the channel 336 of the inner tensioning member 280 (i.e., with the tensioning mechanism 270 in the tightened configuration), the lateral and medial tensioning elements 288, 290 tensioned to a second tension along the lateral and medial sides 216, 218 (see FIG. 5), respectively, of the upper 202. Further, the lateral and medial tensioning elements 288, 290 tensioned to the second tension are in contact with the upper 202, which causes the upper 202 to be compressed or tightened along at least the lateral and medial sides 216, 218 (see FIG. 5). In addition, the lateral and medial tensioning elements 288, 290 pull the tensioning member 272 (via the second ends 288*b*, 290*a* of the lateral and medial tensioning elements 288, 290 attached to the inner tensioning member 280 that is arranged within the fixed outer tensioning member 276) on the instep region 258 of the upper 202 downward toward the sole structure 204 (see FIG. 5), which can tighten or compress the upper 202 along at least the instep region 258.

It is contemplated that the fastening mechanism 270 may be configured to provide a plurality of tightened configurations with varying levels of tightness from the loosened configuration (shown in FIG. 6) based on the amount in which the inner tensioning member 280 is rotated in the first direction 324 relative to the outer tensioning member 276. For example, referring to FIG. 6, from the loosened configuration (shown in FIG. 6), rotation of the inner tensioning member 280 in the first direction 324 that results in movement of the lateral and medial portions 280*a*, 280*b* of the inner tensioning member 280 along about 10% of a total distance of the inner perimeter 330 of the outer tensioning member 276 can result in a first level of tightness (i.e., a first tightened configuration), rotation of the inner tensioning member 280 in the first direction 324 that results in movement of the lateral and medial portions 280*a*, 280*b* of the inner tensioning member 280 along about 20% of the total distance of the inner perimeter 330 of the outer tensioning member 276 can result in a second level of tightness (i.e., a second tightened configuration), rotation of the inner tensioning member 280 in the first direction 324 that results in movement of the lateral and medial portions 280*a*, 280*b* of the inner tensioning member 280 along about 30%, or about 20%, or about 10% of the total distance of the inner perimeter 330 of the outer tensioning member 276 can result in a third level of tightness (i.e., a third tightened configuration), etc.

It is further contemplated that the tensioning member 272 may include a tension holding mechanism 340 (see FIGS. 6-9) that is configured to releasably hold the fastening mechanism 270 in the tightened configuration or in one of a plurality of tightened configurations. For example, in some embodiments, the tension holding mechanism 340 can be arranged along the inner perimeter 330 of the of outer tensioning member 276 and the outer perimeter 328 of the inner tensioning member 280 (as shown in FIGS. 6-9) and can be configured to hold the inner tensioning member 280 at the desired degree of rotation within the outer tensioning member 276, i.e., a desired degree of tightness of the fastening mechanism 270, and prevent rotational movement of the inner tensioning member 280 in at least the second direction 326. In some embodiments, the tension holding mechanism 340 of the fastening mechanism 270 can be a ratcheting system. For example, in such embodiments, a ratcheting system of the fastening mechanism 270 may comprise a plurality of teeth arranged along the outer perimeter 328 of the inner tensioning member 280 and one or more pivoting pawls arranged on the outer tensioning member 276 that is configured to releasably engage the plurality of teeth of the inner tensioning member 280. In such embodiments, the one or more pivoting pawls of the ratcheting system can be pivotable via one or more actuators, such as, e.g., a lever or button 346, that can be arranged on the outer tensioning member 276 or the upper 202 of the article of footwear 200.

In some embodiments, the tension holding mechanism 340 of the fastening mechanism 270 can comprise a plurality of grooves defined in the outer perimeter 328 of the inner tensioning member 280 that are configured to receive one or more protrusions extending inwardly from the inner perimeter 330 of the outer tensioning member 276. In such embodiments, the inner tensioning member 280 can be configured to be raised vertically along the tensioning member axis 284 away from the sole structure 204 of the article of footwear 200 by a user such that the grooves of the inner tensioning member 280 are disengaged with the protrusions of the outer tensioning member 276 (i.e., an unlocked position), rotated in the first direction 324 to achieve the desired level of tightness or rotated in the second direction 326 to loosen the fastening mechanism 270, and then lowered downward along the tensioning member axis 284 with the grooves of the inner tensioning member 280 aligned with and receiving the protrusions of the outer tensioning member 276 (i.e., a locked position). Thus, the grooves and protrusions of the outer and inner tensioning members 276, 280 can prevent rotational movement of the inner tensioning member 280 relative to the outer tensioning member 276 in one or both directions 324, 326. In such embodiments, the inner tensioning member 280 can be biased toward the locked position, such as, e.g., via the tensioning elements 288, 290 or a coil spring (not shown).

Referring again to FIG. 7, from the tightened configuration (as shown in FIG. 7), the fastening mechanism 270 is moveable back to the loosened configuration via rotation of the inner tensioning member 280 in the second direction 326 that is opposite the first direction 324. In some embodiments, the inner tensioning member 280 may be configured to be physically rotated by a user in the first and second directions 324, 326. For example, referring again to FIGS. 4 and 5, the inner tensioning member 280 includes a lateral protrusion 342 adjacent the lateral portion 280*a* and a medial protrusion 344 adjacent the medial portion 280*b* (see FIGS. 6 and 7). The lateral and medial protrusions 342, 344 each extend upwardly from the tensioning member 272 and are provided in the form of knobs or tabs that are configured to be gripped by a user's hand in order to rotate the inner tensioning member 280 in the first and second directions 324, 326. In some embodiments, the fastening mechanism 270 may include the button 346 or other user-activated feature, e.g., on at least one of the protrusions 342, 344, that is configured to automatically move the fastening mechanism 270 from the tightened configuration to the loosened configuration. In other embodiments, the fastening mechanism 270 may include an electromechanical system that automatically moves the fastening mechanism 270 between the loosened configuration and the tightened configuration and/or one of a plurality of tightened configurations therebetween.

Referring to FIGS. 4-7, the tensioning element 274 may be comprised of various materials, such as, e.g., conventional cotton, nylon, or polyester, and may have various shapes, such as, e.g., a circular cross-section to prevent twisting within the channel 336 of the inner tensioning member 280 and improve the operation of the fastening mechanism 270. In some embodiments, the tensioning element 274 comprises a high modulus polyethylene fiber cable having increased strength and abrasion resistance compared to conventional shoelaces. In some embodiments, the tensioning element 274 may comprise an elastomeric material to provide shock absorption to a user wearing the article of footwear 200. In some embodiments, the lateral tensioning element 288 may comprise a first material and the medial tensioning element 290 may comprise a second material having differing properties than the first material, such as, for example, differing colors, width, shapes, and/or elastomeric properties. Similarly, in some embodiments, for example, one or more of the lateral tensioning elements 288 may comprise a first material while one or more of the other lateral tensioning elements 288 may comprise a second material having differing properties than the first material. In some embodiments, the tensioning element 274, e.g., each of the lateral and medial tensioning elements 288, 290, has a diameter in a range of between about 0.30 millimeters (mm) and about 3.0 mm, or between about 0.50 mm and about 2.5 mm, or between about 0.80 mm and about 2.0 mm, or between about 1.2 mm and about 1.7 mm. In some embodiments, one or more of the lateral and medial tensioning elements 288, 290 may have a diameter that differs from that of the other lateral and medial tensioning elements 288, 290.

With continued reference to FIGS. 4-7, it is contemplated that the tensioning member 272 can include three or more tensioning members, in which one or more of the tensioning members may be disposed along the lateral side 216, the medial side 218, and/or a proximal end 222 of the upper 202. In such embodiments, the fastening mechanism 270 may be configured such that rotation of two or more tensioning members causes the fastening mechanism 270 to move between the loosened configuration to the tightened configuration. Further, in some embodiments, the tensioning element 274 can include one or more tensioning elements 274 that extend from the lateral side 216 to the medial side 218 of the footwear 200 and through the tensioning member 272 disposed on the instep region 258 of the upper 202. In other embodiments, the lateral tensioning element 288 can include two to five or seven or more distinct lateral tensioning elements, and the medial tensioning element 290 can include two to five or seven or more distinct medial tensioning elements. In some embodiments, the lateral tensioning element 288 may include more distinct tensioning elements than the medial tensioning element 290, or vice versa.

Figure 9:
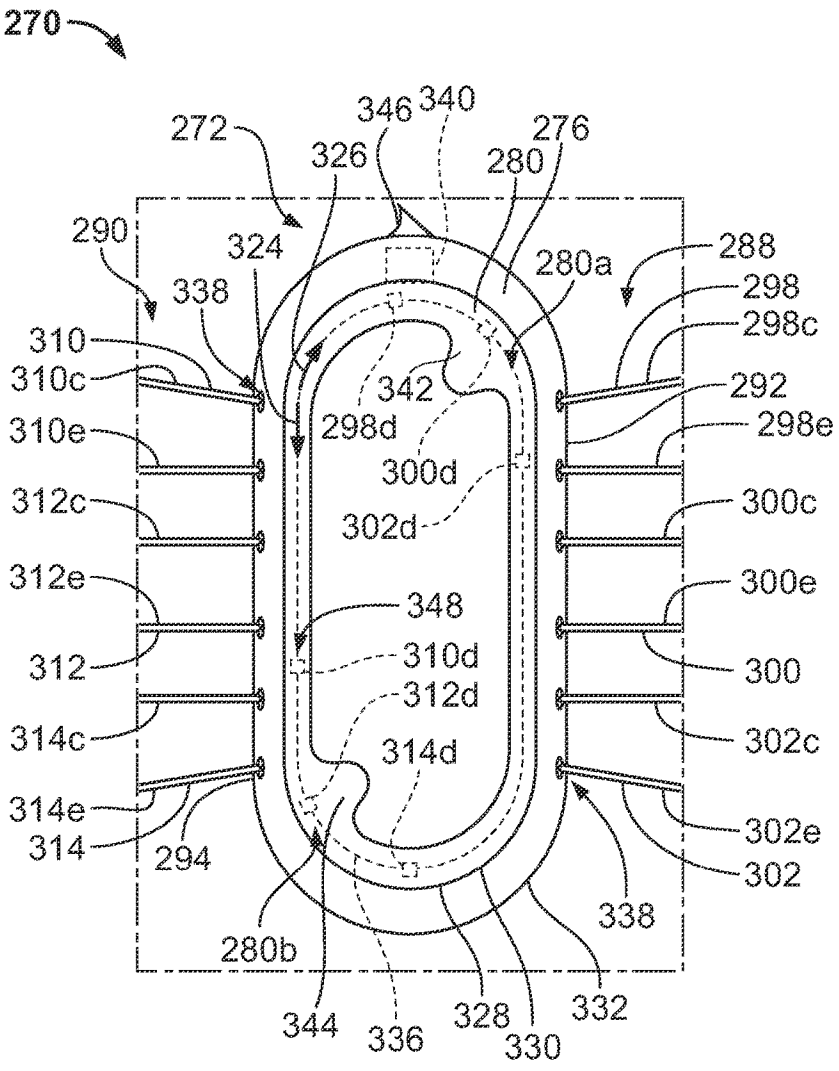
FIG. 9 is a top detail view of the fastening mechanism of FIG. 8 in a tightened configuration.
Figure 8:
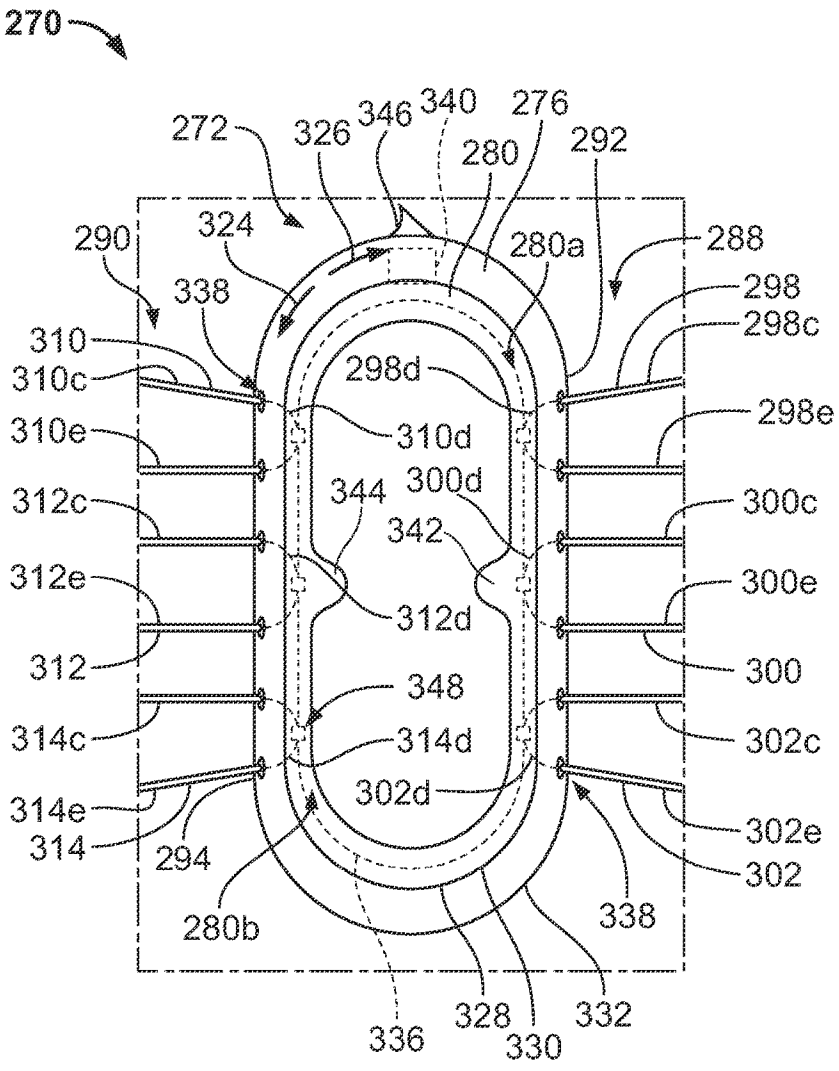
FIG. 8 is a top detail view of another example fastening mechanism of the article of footwear of FIG. 4 in a loosened configuration, according to another embodiment of the disclosure.

Referring now to FIGS. 8 and 9, another embodiment of the fastening mechanism 270 is depicted in which the lateral tensioning element 288 and the medial tensioning element 290 are configured to form one or more loops that extend from the sole structure 204 and are operably engaged or coupled with the tensioning member 272. In particular, the fastening mechanism 270 of the article of footwear 200 of FIGS. 8 and 9 is similar to the previous embodiment of FIGS. 4-7, with like elements being indicated by similar reference numerals. In the illustrated embodiments of FIGS. 8 and 9, the lateral tensioning element 288 includes the first, second, and third lateral tensioning elements 298, 300, 302 that are configured to form three lateral tensioning loops extending along the lateral side 216 of the upper 202 (see FIGS. 4 and 5). Similarly, the medial tensioning element 290 includes the first, second, and third medial tensioning elements 310, 312, 314 that are configured to form three medial tensioning loops extending along the medial side 218 of the upper 202 (see FIGS. 4 and 5).

Referring in particular to FIG. 8, the first ends 298*a*, 300*a*, 302*a* of the first, second, and third lateral tensioning elements 298, 300, 302, respectively, extend from the lateral side 216 of the sole structure 204 toward the lateral side 292 of the outer tensioning member 276 such that first portions 298*c*, 300*c*, 302*c* of the first, second, and third lateral tensioning elements 298, 300, 302, respectively, are adjacent the lateral side 216 of the upper 202 (see FIGS. 4 and 5). Segments 298*d*, 300*d*, 302*d* of the first, second, and third lateral tensioning elements 298, 300, 302, respectively, extend from the first portions 298*c*, 300*c*, 302*c* through the corresponding apertures 338 in the lateral side 292 of the outer tensioning member 276, through a corresponding tensioning element retainer 348, shown in phantom lines, disposed within the channel 336 of the inner tensioning member 280, and through adjacent corresponding apertures 338 in the lateral side 292 of the outer tensioning member 276 toward the sole structure 204.

The tensioning element retainers 348 are configured to slidably retain portions of the tensioning elements and may comprise a variety of internal structures within the channel 336 of the inner tensioning member 280, such as, e.g., apertures or hooks. Second portions 298*e*, 300*e*, 302*e* of the first, second, and third lateral tensioning elements 298, 300, 302, respectively, extend along the lateral side 216 of the upper 202 from the outer tensioning member 276 to the sole structure 204 adjacent to the first portions 298*c*, 300*c*, 302*c*. In some embodiments, the second portions 298*e*, 300*e*, 302*e* of the lateral tensioning elements 298, 300, 302 can extend along the lateral side 216 of the upper 202 in a direction that is parallel to a direction of the first portions 298*c*, 300*c*, 302*c*, respectively. In other embodiments, the second portions 298*e*, 300*e*, 302*e* of the lateral tensioning elements 298, 300, 302 can extend along the lateral side 216 of the upper 202 being disposed at an angle with respect to the first portions 298*c*, 300*c*, 302*c*.

Referring still to FIG. 8, the second ends 298*b*, 300*b*, 302*b* of the first, second, and third lateral tensioning elements 298, 300, 302 may be fixedly attached to the sole structure 204 (see FIGS. 4 and 5) adjacent to the corresponding fixedly attached first ends 298*a*, 300*a*, 302*a*, respectively. Thus, in the illustrated embodiment, each of the first, second, and third lateral tensioning elements 298, 300, 302 form a fixed loop with the segments 298*d*, 300*d*, 302*d* that is slidably retained within the lateral portion 280*a* of the inner tensioning member 280 via the tensioning element retainers 348. In some embodiments, one or more of the lateral tensioning elements 298, 300, 302 can be closed loops, i.e., having first and second ends 298*a*, 298*b*, 300*a*, 300*b*, 302*a*, 302*b*, respectively, being joined, that are slidably received in one or more tensioning element receivers (not shown) arranged on the lateral side 216 of the sole structure 204 and/or the upper 202. In the illustrated embodiment, the first, second, and third medial tensioning elements 310, 312, 314 are configured similarly to the first, second, and third lateral tensioning elements 298, 300, 302, such that first portions 310*c*, 312*c*, 314*c* and second portions 310*e*, 312*e*, 314*e* of the first, second, and third medial tensioning elements 310, 312, 314, respectively, are adjacent the medial side 218 of the upper 202 (see FIGS. 4 and 5) with segments 310*d*, 312*d*, 314*d* being slidably retained within the medial portion 280*b* of the inner tensioning member 280 via the corresponding tensioning element retainers 348.

Referring to FIG. 9, in the illustrated embodiment, when the inner tensioning member 280 is rotated in the first direction 324, the tensioning element retainers 348 move with the inner tensioning member 280 in the first direction 324 and the fastening mechanism 270 is moved to the tightened configuration. As the tensioning element retainers 348 rotate in the first direction 324, the segments 298*d*, 300*d*, 302*d*, 310*d*, 312*d*, 314*d* (for illustration purposes, depicted in FIG. 9 as points or sections within the tensioning element retainers 348) retained within the corresponding tensioning element retainers 348 slidably move with the tensioning element retainers 348, causing the lateral and medial tensioning elements 298, 300, 302, 310, 312, 314 to be tensioned to the second tension. When the second tension is achieved, the lateral and medial tensioning elements 298, 300, 302, 310, 312, 314 are in contact with the upper 202 and cause the upper 202 to be compressed or tightened along at least the lateral and medial sides 216. 218 (see FIGS. 4 and 5). In addition, the lateral and medial tensioning elements 298, 300, 302, 310, 312, 314 on the instep region 258 of the upper 202 pull the tensioning member 272 downward toward the sole structure 204 via the segments 298*d*, 300*d*,

302*d*, 310*d*, 312*d*, 314*d* that are disposed within the tensioning element retainers 348. From the tightened configuration (as shown in FIG. 9), the fastening mechanism 270 is moved to the loosened configuration by rotation of the inner tensioning member 280 in the second direction 326.

In other embodiments, the lateral tensioning element 288 may comprise one or more lateral tensioning elements forming lateral tensioning loops having segments that are operably engaged or coupled with the inner tensioning member 280 while the medial tensioning element 288 may comprise one or more medial tensioning elements having ends fixedly attached to the inner tensioning member 280 and other ends fixedly attached to the upper 202 and/or sole structure 204, or vice versa. In some embodiments, the lateral tensioning element 288 and the medial tensioning element 290 can form closed loops having first and second portions that extend along the lateral side 216 and the medial side 218 of the upper 202, first segments that are received within the inner tensioning member 280, and second segments that are received within one or more tensioning element receivers (not shown) arranged on the upper 202 and/or sole structure 204.

Referring now to FIGS. 10-13, another exemplary embodiment of an article of footwear 400 is depicted, which includes an upper 402, a sole structure 404, and a fastening mechanism 470. The article of footwear 400 is similar to previous embodiments, with like elements being indicated by similar reference numerals under the "4xx" series and the "5xx" series of reference numerals. For example, the article of footwear 400 includes the upper 402 with an interior surface 452 and an exterior surface 454 and the sole structure 404 including a midsole 462 and an outsole 464, just as the article of footwear 100 include the upper 402 and the sole structure 404. While the fastening mechanism 470 of the article of footwear 400 is similar to previous embodiments in many aspects, there are some aspects that differ. In particular, a tensioning member 472 of the fastening mechanism 470 includes a first or proximal tensioning member 476 and a second or distal tensioning member 480 that are arranged at a distance from each other and around different portions of the upper 402 and the sole structure 404 of the article of footwear 400. A tensioning element 474 of the fastening mechanism 470 extends between, and is operably engaged or coupled with, the proximal and distal tensioning members 476, 480, such that the fastening mechanism 470 can tighten and/or loosen the article of footwear 400 around a user's foot.

Figure 10:
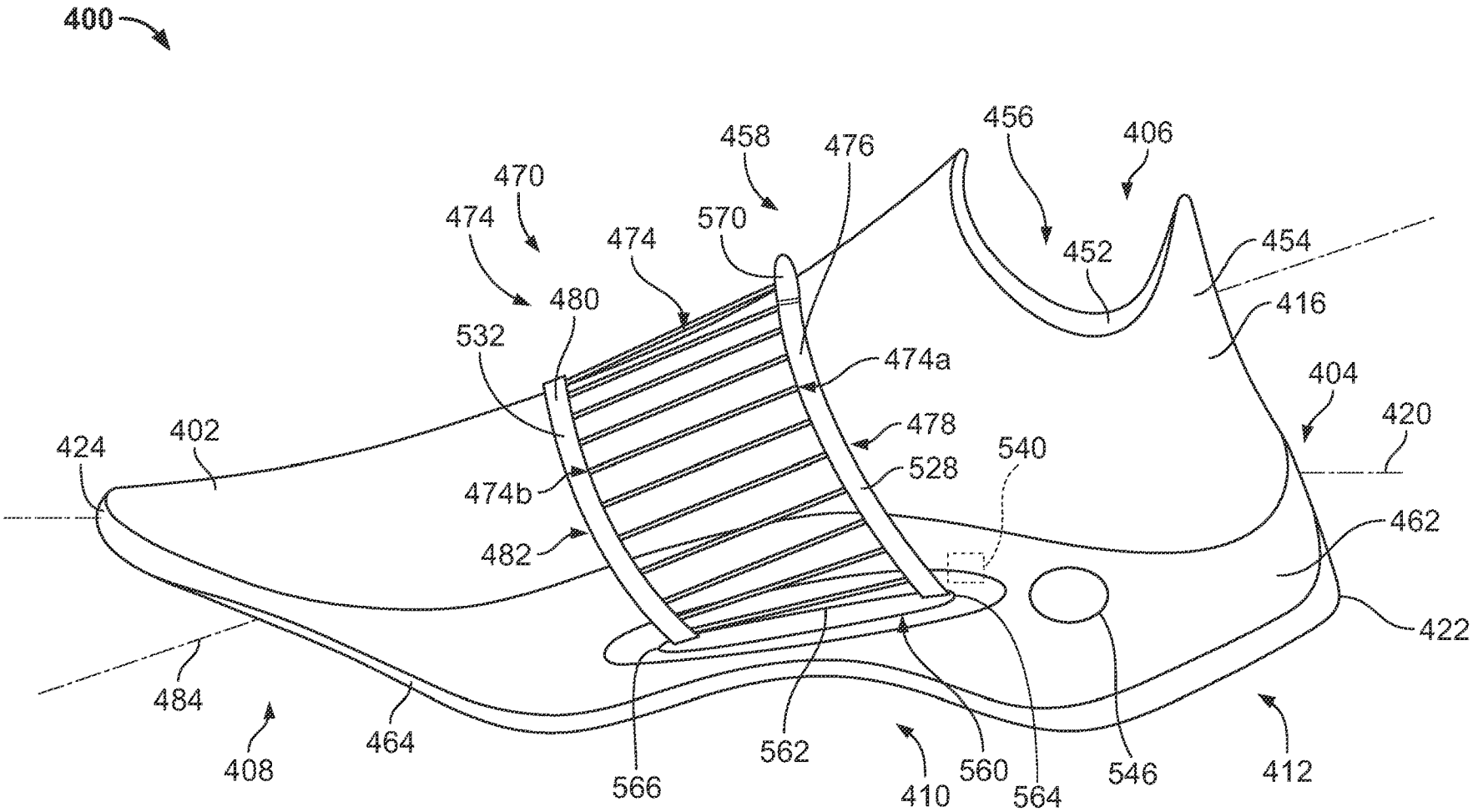
FIG. 10 is a lateral side view of another example article of footwear configured as a left shoe with a fastening mechanism in a loosened configuration, according to another embodiment of the disclosure.
Figure 11:
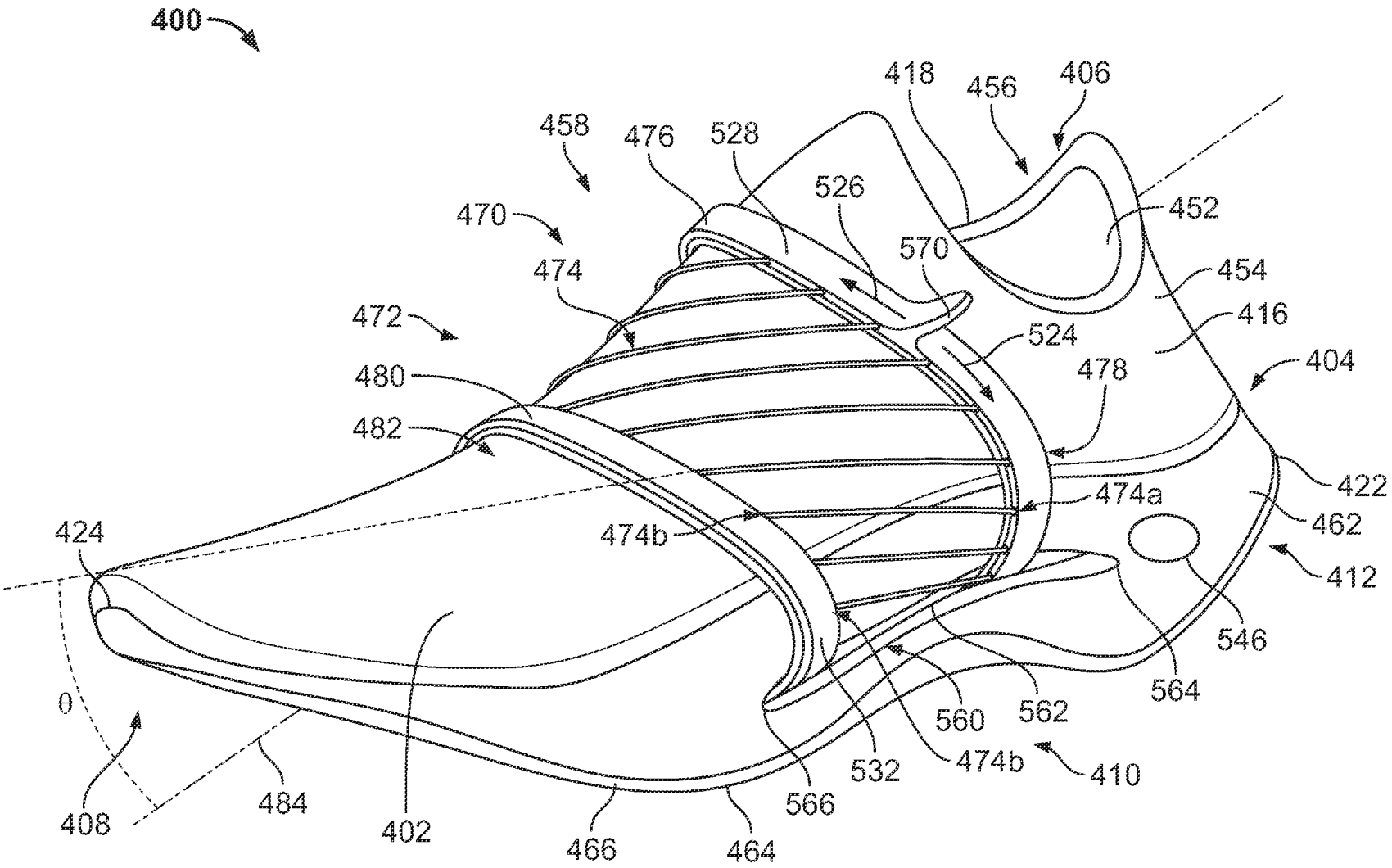
FIG. 11 is a perspective view of a lateral and toe side of the article of footwear of FIG. 10.
Figure 12:
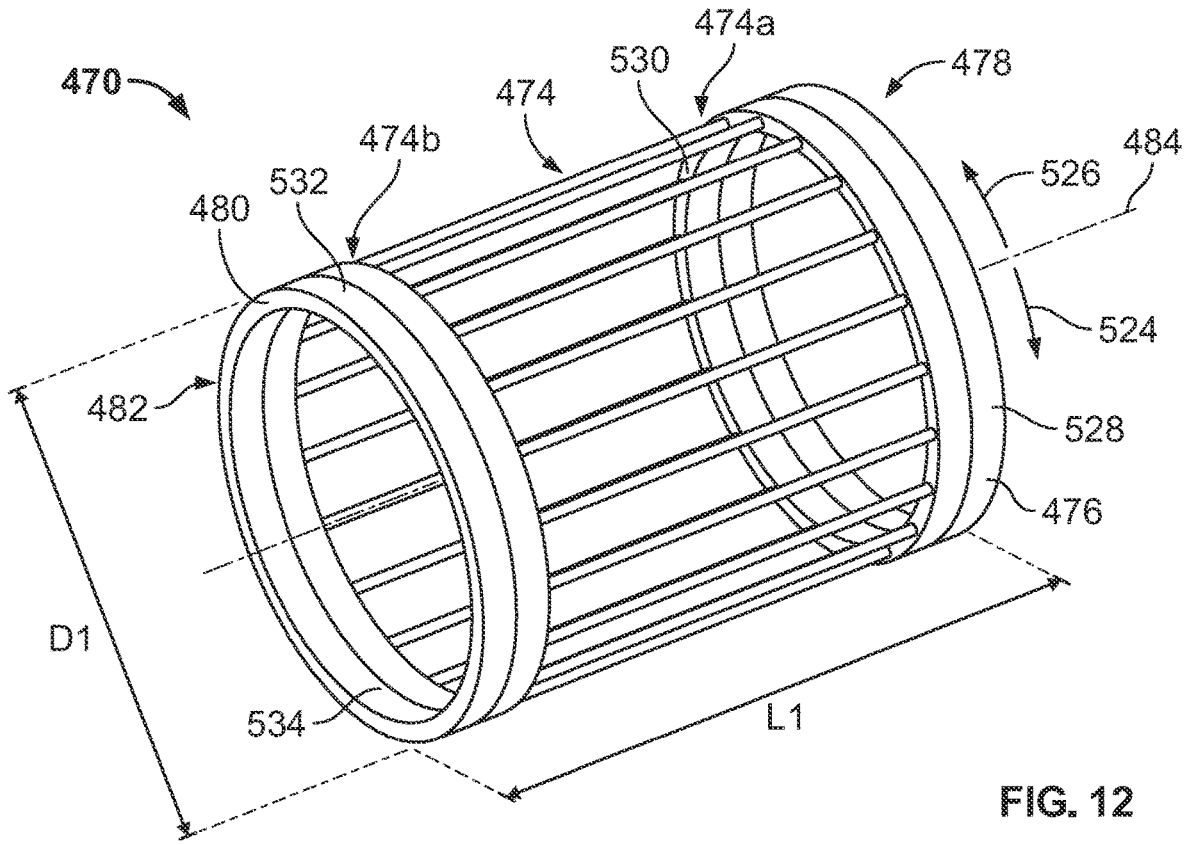
FIG. 12 is a perspective view of the fastening mechanism of the article of footwear of FIG. 10 in the loosened configuration.
Figure 13:
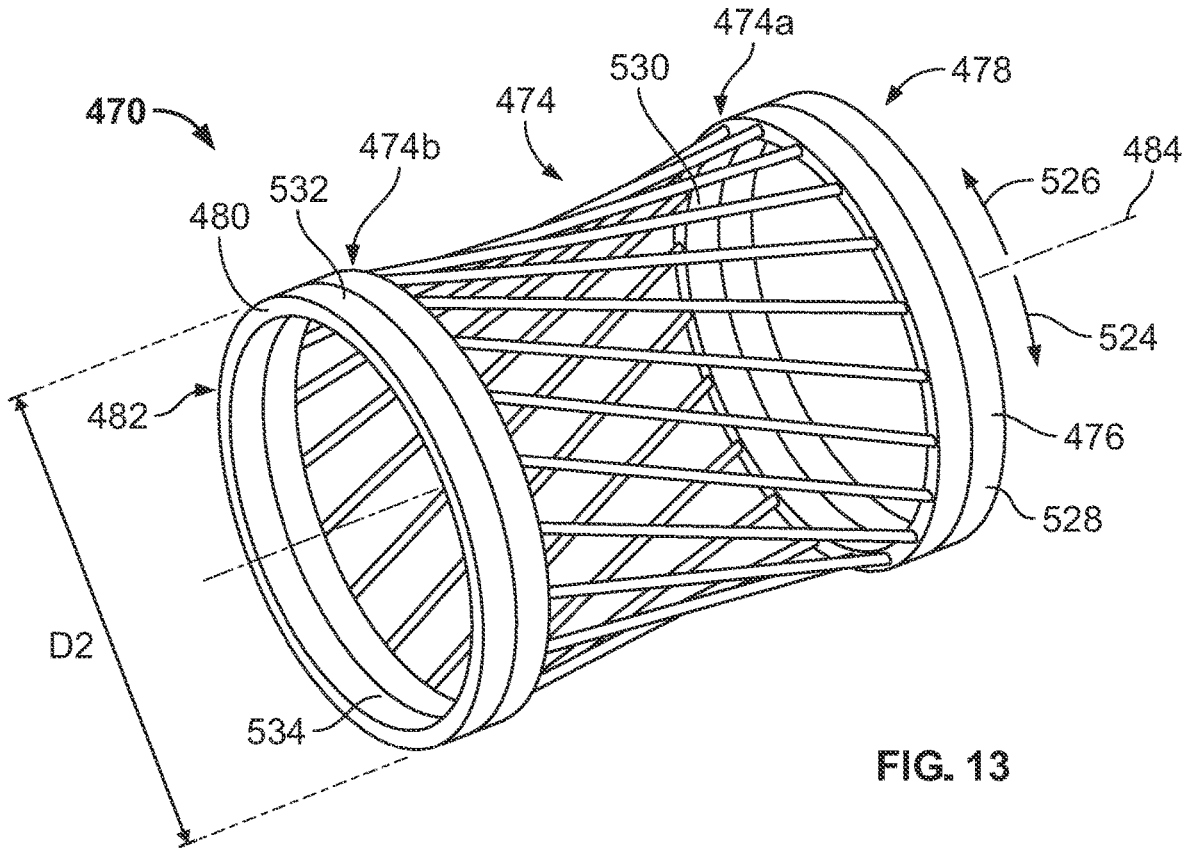
FIG. 13 is a perspective view of the fastening mechanism of FIG. 12 in a tightened configuration.

Referring to FIGS. 10 and 12, the proximal and distal tensioning members 476, 480 each have member openings 478, 482 having a first diameter D1 (see FIG. 12) defined by inner perimeters or surfaces 530, 534 of the proximal and distal tensioning members 476, 480, respectively. The inner surfaces 530, 534 are opposite outer perimeters or surfaces 528, 532 of the proximal and distal tensioning members 476, 480, respectively. Referring to FIG. 10, the proximal and distal tensioning members 476, 480 each extend around different portions of a lateral side 416, a medial side 418 (see FIG. 11), and an instep region 458 of the upper 402 and through a sole aperture 560 defined by the sole structure 404. In the illustrated embodiment, the sole aperture 560 extends through the midsole 462 of the sole structure 404 from the lateral side 416 to the medial side 418 of the sole structure 404. Thus, the inner surfaces 530, 534 of the proximal and distal tensioning members 476, 480 contact the lateral side 416, the medial side 418, and the instep region 458 of the upper 402 and, in some configurations, at least an upper side 562 of the sole aperture 560.

Referring to FIG. 10, in the illustrated embodiment, the tensioning members 476, 480 are concentrically aligned about a tensioning member axis 484 and are spaced apart from each other at a length L1 (see FIG. 12) along the tensioning member axis 484. More specifically, the proximal tensioning member 476 is arranged toward an opening 456 of the upper 402 and adjacent to a first or proximal side 564 of the sole aperture 560, and the distal tensioning member 480 is arranged toward a distal end 424 of the upper 402 and adjacent to a second or distal side 566 of the sole aperture 560. In the illustrated embodiment, the proximal and distal tensioning members 476, 480 are fixed such that the length L1 is constant. In some embodiments, the article of footwear 400 may be configured such that the proximal tensioning member 476 and/or the distal tensioning member 480 are moveable laterally about the tensioning member axis 484 such that the length L1 between the proximal and distal tensioning members 476, 480 is variable. In such embodiments, the proximal tensioning member 476 and/or the distal tensioning member 480 may be biased toward the proximal side 564 and/or the distal side 566, respectively, of the sole aperture 560 (i.e., toward a proximal end 422 and/or distal end 424 of the article of footwear 400), such as, e.g., via a biasing member arranged within the sole aperture 560.

With continued reference to FIG. 10, in the illustrated embodiment, the aperture 560 and, thus, the proximal and distal tensioning members 476, 480, are substantially located in a midfoot region 410 of the sole structure 404. In other embodiments, the proximal tensioning member 476 can be located in a heel region 412 of the sole structure 404 and the distal tensioning member 480 can be located in a forefoot region 408 of the sole structure 404. In some embodiments, the tensioning member 472 can include only one of the proximal or distal tensioning members 476, 480 having one end of the tensioning element 474 fixedly attached thereto and the other end of the tensioning element 474 being fixedly attached to the upper 402 and/or the sole structure 404. In other embodiments, the tensioning member 472 can include three or more tensioning members, and one or more tensioning members may be disposed on the proximal end 422 of the upper 402 and/or the sole structure 404. In some embodiments, the sole structure 404 can include a plurality of sole apertures 560, such as for example, a first sole aperture located in the forefoot region 408 configured to receive the distal tensioning member 480 and a second sole aperture located in the midfoot region 410 and/or the heel region 412 configured to receive the proximal tensioning member 476.

Referring still to FIG. 10, in the illustrated embodiment, the tensioning element 474 includes a plurality of tensioning elements each having a first or proximal end 474*a* that is fixedly attached to the proximal tensioning member 476, and a second or distal end 474*b* that is fixedly attached to the distal tensioning member 480. Thus, the plurality of tensioning elements 474 extend between the proximal and distal tensioning members 476, 480 and along portions of the upper 402 and the sole structure 404 of the article of footwear 400. In some embodiments, the one or more tensioning element receivers (not shown) can be defined along the upper 202 between the tensioning members 476, 480 that are configured to receive at least portions of the one or more of the plurality of tensioning elements 474 between the proximal and distal ends 474*a*, 474*b*. In some embodiments, at least some of the plurality of tensioning elements 474 can have at least one of the proximal or distal ends 474*a*, 474*b* attached to the upper 202. For example, in some embodiments, at least some of the proximal ends 474*a* of the plurality of tensioning elements 474 can be fixedly attached to the upper 202 between the proximal tensioning member 476 and the proximal end 422 of the upper 202 and/or at least some of the distal ends 474*b* of the plurality of tensioning elements 474 can be fixedly attached to the upper 202 between the distal tensioning member 480 and the distal end 424 of the upper 202. In some embodiments, at least some of the plurality of tensioning elements 474 can have at least one of the proximal or distal ends 474*a*, 474*b* attached to the sole structure 404, such as, e.g., to the upper side 562 of the sole aperture 560.

Referring to FIGS. 10 and 11, the fastening mechanism 470 of the article of footwear 400 is configured to be moveable between a loosened configuration (shown in FIGS. 10 and 12), in which the plurality of tensioning elements 474 are tensioned to a first tension, and a tightened configuration (shown in FIGS. 11 and 13), in which the plurality of tensioning elements 474 are tensioned to a second tension that is greater than the first tension, via rotation of at least one of the proximal tensioning member 476 and/or the distal tensioning member 480. In particular, with the fastening mechanism 470 in the loosened configuration (shown in FIGS. 10 and 12), each of the plurality of tensioning elements 474 tensioned to the first tension extend parallel with respect to the tensioning member axis 484 (and thus, also parallel to each other) between the tensioning members 476, 480 and along the lateral side 416, the medial side 418, and the instep region 458 of the upper 402, and extend orthogonally with respect to the tensioning members 476, 480. Thus, each of the tensioning elements 474 have a length that is at least equal to the length L1 (see FIG. 12) between the tensioning members 476, 480.

Referring to FIG. 11, the fastening mechanism 470 is illustrated having been moved to the tightened configuration (shown in FIGS. 11 and 13) via rotation of the proximal tensioning member 476 by a user in a first direction 524 about the tensioning member axis 484 relative to the distal tensioning member 480. As such, the proximal tensioning member 476 includes a protrusion 570 extending outwardly from the outer surface 528 of the proximal tensioning member 476 that is configured to be gripped by a user's hand to rotate the proximal tensioning member 476. As the proximal tensioning member 476 is rotated in the first direction 524, the fixed first ends 474*a* of the plurality of tensioning elements 474 move with the proximal tensioning member 476 in the first direction 524 while the second ends 474*b* of the plurality of tensioning elements 474 remain fixed in place on the stationary distal tensioning member 480. Thus, rotation of the proximal tensioning member 476 in the first direction 524 relative to the distal tensioning member 480 causes each of the plurality of tensioning elements 474 to extend at an angle Θ along the upper 402 relative to the tensioning member axis 484 and to be tensioned to the second tension.

The plurality of tensioning elements 474 tensioned to the second tension pull the lateral side 416 and the medial side 418 of the upper 402 inward, while also pulling the instep region 458 of the upper 402 downward, toward the sole structure 404. As described above, in the illustrated embodiment, the inner surfaces 530, 534 of the proximal and distal tensioning members 476, 480 are fixed to the upper 402 and the upper side 562 of the sole aperture 560, such that the length L1 (see FIG. 12) between the proximal and distal tensioning members 476, 480 is fixed. In other embodiments, the article of footwear 400 can be configured such that the plurality of tensioning elements 474 tensioned to the second tension pull the distal tensioning member 480 laterally along the tensioning member axis 484 toward the proximal tensioning member 476, such that the length L1 (see FIG. 12) is decreased when the fastening mechanism 470 moves to the tightened configuration. In such embodiments, the distal tensioning member 480 can be biased toward the distal side 566 of the sole aperture 560. For example, in such embodiments, the upper side 562 of the sole aperture 560 can define a sole channel (not shown) that receives a portion of the distal tensioning member 480 and a biasing member (not shown) can be arranged within the sole channel that engages the portion of the distal tensioning member 480.

With continued reference to FIG. 11, in some embodiments, the fastening mechanism 470 can be moveable from the loosened configuration to the tightened configuration by rotation of the proximal tensioning member 476 in either the first direction 524 or a second direction 526 that is opposite the first direction 524. In such embodiments, when the proximal tensioning member 476 is rotated in the second direction 526, the plurality of tensioning elements 474 extend at an angle that is inverse to the angle Θ. In other embodiments, the fastening mechanism 470 can be configured such that the fastening mechanism 470 can be moveable from the loosened configuration to the tightened configuration by rotation of the distal tensioning member 480 in the first or second directions 524, 526 relative to the proximal tensioning member 476. In some embodiments, the fastening mechanism 470 can be moveable from the loosened configuration to the tightened configuration by rotation of both the proximal tensioning member 476 in the first direction 524 and the distal tensioning member 480 in the second direction 526, or vice versa.

It is contemplated that at least the proximal tensioning member 476 can include a tension holding mechanism 540 (see FIG. 10) that is configured to releasably hold the fastening mechanism 470 in the tightened configuration or in one of a plurality of tightened configurations. For example, in some embodiments, the tension holding mechanism 540 of the fastening mechanism 470 can be arranged between the inner surface 530 (see FIG. 12) and/or outer surface 528 of the proximal tensioning member 476 and one or more sides of the sole aperture 560, and can be configured to releasably hold the proximal tensioning member 476 at the desired degree of rotation relative to the distal tensioning member 480, i.e., a desired degree of tightness of the fastening mechanism 470, and prevent rotational movement of the proximal tensioning member 476 in at least the second direction 526. In other embodiments, the tension holding mechanism 540 can be arranged along portions of the upper 402 and/or the sole structure 404 that is configured to releasably hold the proximal tensioning member 476. In some embodiments, the tension holding mechanism 540 of the fastening mechanism 470 can comprise a plurality of protrusions extending outwardly from the upper 402 that are configured to be received by one or more openings or grooves disposed on the inner surface 530 of the proximal tensioning member 476, or vice versa.

In some embodiments, the tension holding mechanism 540 (see FIG. 10) of the fastening mechanism 470 can be a ratcheting system. For example, in such embodiments, a ratcheting system of the fastening mechanism 470 may comprise a plurality of teeth arranged along the inner surface 530 of the proximal tensioning member 476 and one or more pivoting pawls arranged on the upper, proximal, and/or distal sides 562, 564, 566 of the sole aperture 560 that is configured to releasably engage the plurality of teeth of the proximal tensioning member 476. In such embodiments, the one or more pivoting pawls of the ratcheting system can be pivotable via one or more actuators, such as, e.g., a lever or button 546, that can be arranged on the lateral side 416 and/or medial side 418 of the sole structure 404 or the upper 402 of the article of footwear 400. In other embodiments, a ratcheting system of the fastening mechanism 470 can comprise a plurality of teeth arranged along the outer surface 528 of the proximal tensioning member 476 and one or more pivoting pawls arranged on a fourth or lower side of the sole aperture 560 that is configured to releasably engage the plurality of teeth of the proximal tensioning member 476. In such embodiments, the one or more pivoting pawls of the ratcheting system can be pivotable via one or more actuators, such as, e.g., the lever or button 546, that can be arranged on the lateral side 416 and/or medial side 418 of the sole structure 404 or the upper 402 and/or on the bottom surface 466 (see FIG. 11) of the sole structure 404 of the article of footwear 400.

In some embodiments, the tension holding mechanism 540 of the fastening mechanism 470 can comprise a plurality of hooks and a plurality of loops, i.e., corresponding male and female strips of hook and loop fasteners, such as Velcro®. In such embodiments, and referring to FIG. 11, the plurality of hooks can be arranged along the inner surface 530 of the proximal tensioning member 476 near the protrusion 570 and the plurality of loops can be arranged along the instep region 458, the lateral side 416, and/or the medial side 418 of the upper 402 of the article of footwear 400 adjacent to the location of the proximal tensioning member 476. In such embodiments, and still referring to FIG. 11, the proximal tensioning member 476 can be configured to be elastically expandable when a user pulls outwardly on the protrusion 570 such that the plurality of hooks on the inner surface 530 are disengaged with a first portion of the plurality of loops of the upper 402, and then can be rotated in the first direction 524 to the tightened configuration and/or in the second direction 526 to the loosened configuration, and then can be released by the user such that the proximal tensioning member 476 returns to its original shape and the plurality of hooks on the inner surface 530 of the proximal tensioning member 476 reengage a second portion of the plurality of loops on the upper 402.

Referring to FIGS. 10-13, it is further contemplated that at least one of the proximal and distal tensioning members 476, 480 can be configured to elastically deform around a user's foot that is inserted into the upper 402 and, thus, also inserted through the openings 478, 482 of the proximal and distal tensioning members 476, 480 that are adjacent the upper 402. For example, at least one of the proximal tensioning member 476 and/or the distal tensioning member 480 may comprise an elastomeric material such that at least the inner surfaces 530, 534 defining the openings 478, 482 of the proximal and distal tensioning members 476, 480 can: (i) elastically contract from the first diameter D1 (see FIG. 12) to a second diameter D2 (see FIG. 13) that is less than the first diameter D1; and/or (ii) elastically expand from the first diameter D1 to a third diameter D3 (not shown) that is greater than the first diameter D1. In such embodiments, when the fastening mechanism 470 is in the tightened configuration (shown in FIGS. 11 and 13), at least the openings 478, 482 of the proximal and distal tensioning members 476, 480 can elastically contract to the second diameter D2 (see FIG. 13) around the user's foot disposed within the interior cavity 406 of the upper 402 by the plurality of tensioning elements 474 tensioned to the second tension.

Similarly, in such embodiments, when the fastening mechanism 470 is in the loosened configuration (shown in FIGS. 10 and 12), the openings 478, 482 of the proximal and distal tensioning members 476, 480 can elastically deform to the third diameter D3 (not shown) in order to accommodate wider portions of the user's foot, e.g., the ball 132 of the foot 128 (see FIG. 3), as it is inserted into the interior cavity 406 through the opening 456 of the upper 402 and with the plurality of tensioning elements 474 tensioned to the first tension. In some embodiments, at least a portion of the proximal tensioning member 476 may comprise a first material and at least a portion of the distal tensioning member 480 may comprise a second material that has less elasticity than the first material, or vice versa.

In some embodiments, the tensioning member 472 of the fastening mechanism 470 can include a connecting tube (not shown) attached to each of the proximal and distal tensioning members 476, 480 that is configured to contact a portion of a user's foot between the tensioning members 476, 480 to provide increased support to the foot. In such embodiments, at least a portion of the connecting tube (not shown) of the tensioning member 472 may comprise an elastomeric material to adapt to a user's foot. In such embodiments, the plurality of tensioning elements 474 of the fastening mechanism 470 can extend along an exterior surface of the connecting tube or within the exterior surface and an interior surface of the connecting tube.

It is further contemplated that the fastening mechanism 470 can be configured such that the openings 478, 482 of the proximal and distal tensioning members 476, 480 are arranged around only the upper 402, i.e., not around portions of the sole 404 via the sole aperture 560. For example, the sole aperture 560 can instead be a sole channel (not shown) that extends through the midsole 462 and an insole, such as, e.g., the insole 126 of the article of footwear 100 of FIG. 2, of the sole structure 404 such that an open side of the sole channel faces upwardly from the sole structure 404 along the insole. In such embodiments, at least one of the inner surfaces 530, 534 of the proximal and distal tensioning members 476, 480 can continuously contact a cross-section of the upper 402 along the tensioning member axis 484, providing direct support around the corresponding cross-section of the user's foot.

Figure 14:
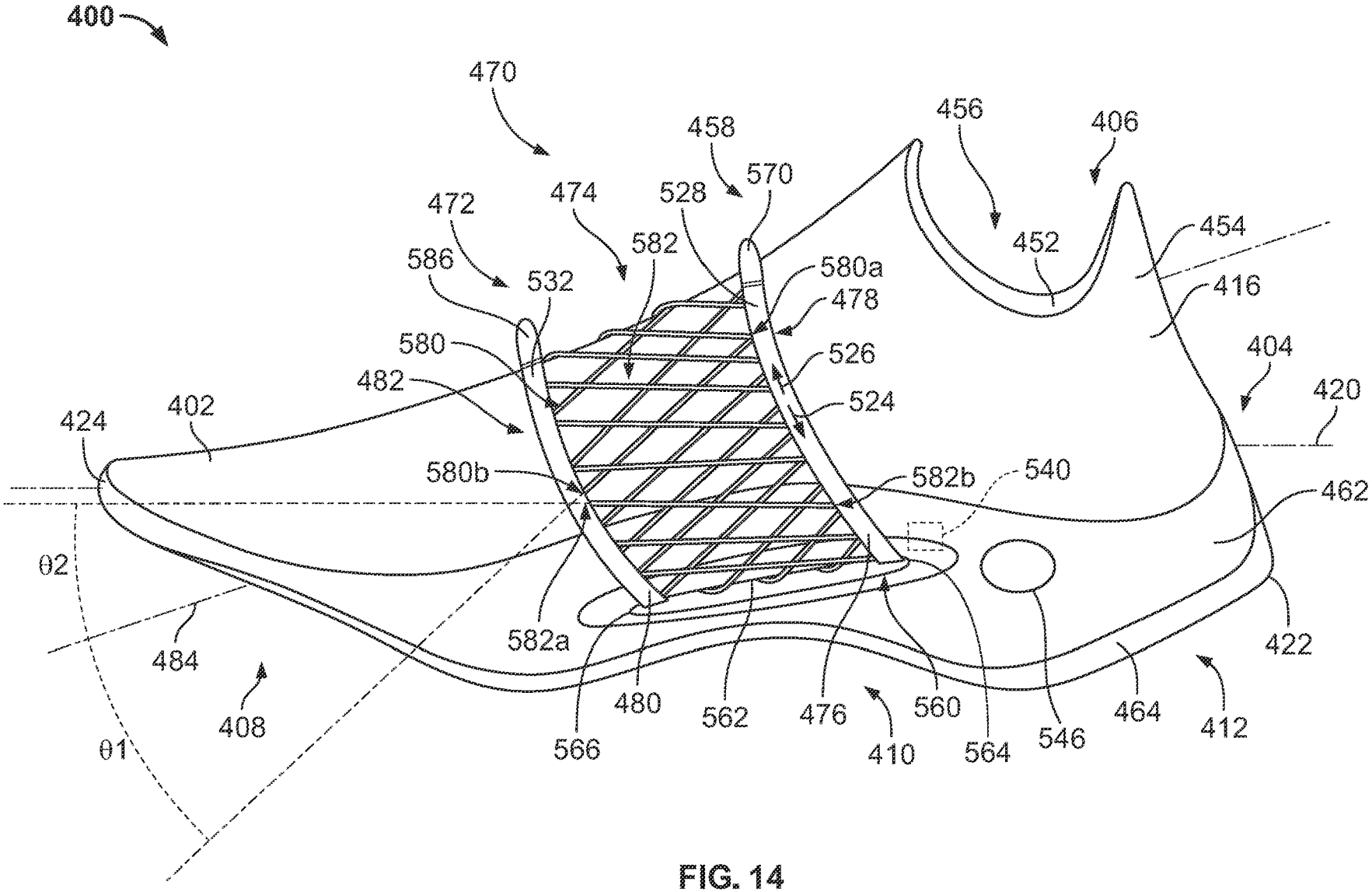
FIG. 14 is a lateral side view of the article of footwear of FIG. 10 with another example fastening mechanism, according to another embodiment of the disclosure.
Figure 15:
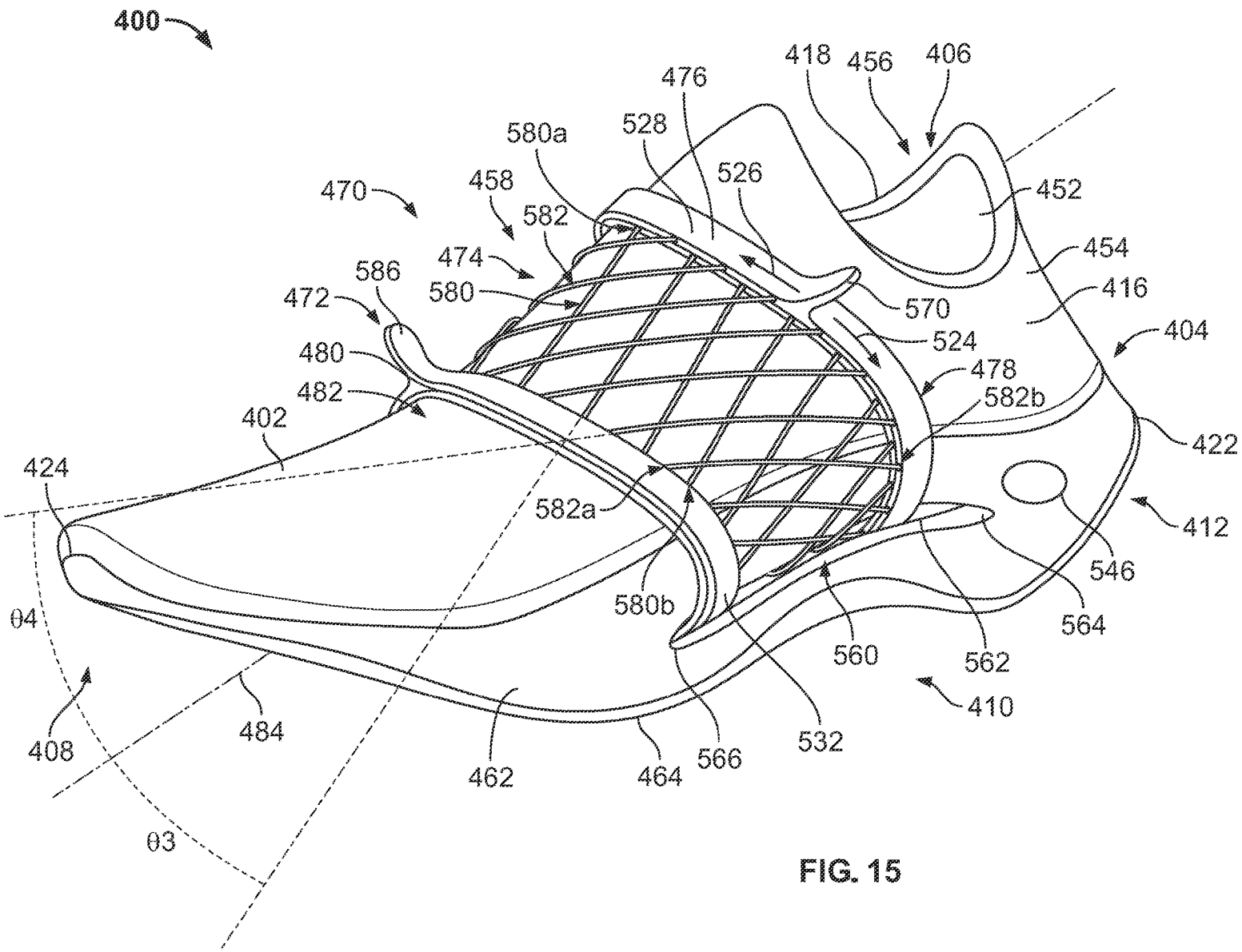
FIG. 15 is a perspective view of a lateral and toe side of the article of footwear of FIG. 14.

It is still further contemplated that the fastening mechanism 470 can be configured to include two or more sets of tensioning elements 474 extending at differing or opposite angles Θ along the upper 402 in order to more evenly distribute compression force along the upper 402 from the tensioning element 474 when the fastening mechanism 470 is in a tightened configuration. Referring now to FIGS. 14 and 15, for example, another embodiment of the fastening mechanism 470 is depicted. In the illustrated embodiment of FIGS. 14 and 15, the tensioning element 474 of the fastening mechanism 470 includes a first plurality of tensioning elements 580 and a second plurality of tensioning elements 582.

As shown in FIG. 14, the first plurality of tensioning elements 580 each have a first end 580*a* that is fixedly attached to the upper 402 or sole 404 below the inner surface 530 of the proximal tensioning member 476 and a second end 580*b* fixedly attached to the distal tensioning member 480. In addition, the first plurality of tensioning elements 580 extend along the upper 402 between the proximal and distal tensioning members 476, 480 at a first angle Θ1 relative to the tensioning member axis 484 and measured in each of a first plurality of planes that correspond and extend parallel to each of the first plurality of tensioning element 580. The second plurality of tensioning elements 582 each have a first end 582*a* that is fixedly attached to the upper 402 or sole 404 below the inner surface 534 of the distal tensioning member 480 and a second end 582*b* fixedly attached to the proximal tensioning member 476. Further, the second plurality of tensioning elements 582 extend along the upper 402 between the proximal and distal tensioning members 476, 480 at a second angle Θ2 relative to the tensioning member axis 484 and measured in each of a second plurality of planes that correspond to and extend parallel to each of the second plurality of tensioning elements 582, and each of the second plurality of planes correspond to each of the respective first plurality of planes. In the illustrated embodiment, the second angle Θ2 is the inverse of the first angle Θ1 relative to the tensioning member axis 484 in each of the first and second pluralities of planes, such that the first and the second pluralities of tensioning elements 580, 582 intersect each other along the upper 402 between the proximal and distal tensioning members 476, 480.

Referring again to FIGS. 14 and 15, the fastening mechanism 470 is configured to be movable between an initial or loosened configuration (shown in FIG. 14), in which each of the first and second pluralities of tensioning elements 580, 582 are tensioned to a first tension, and a tightened configuration (shown in FIG. 15) in which each of the first and second pluralities of tensioning elements 580, 582 are tensioned to a second tension that is greater than the first tension. In the illustrated embodiment, the different tensions are achieved via rotation of each of the proximal tensioning member 476 and the distal tensioning member 480. As shown in FIG. 14, with the fastening mechanism 470 in the loosened configuration, the first and the second pluralities of tensioning elements 580, 582 tensioned to the first tension extend in a crisscrossing manner along a portion of the upper 402 between the proximal and distal tensioning members 476, 480. In some embodiments, the fastening mechanism 470 can be configured such that the first and second plurality of tensioning elements 580, 582 tensioned to the first tension extend parallel to each other along the portion of the upper 402 between the proximal and distal tensioning members 476, 480. In some embodiments, the fastening mechanism 470 can be configured such that the first and second plurality of tensioning elements 580, 582 tensioned to the first tension extend at angles measured in planes perpendicular to axes extending from each tensioning element 580, 582 to a longitudinal axis 420 (see FIG. 14) of the article of footwear 400 that are substantially parallel to the longitudinal axis 420 along the portion of the upper 402 between the proximal and distal tensioning members 476, 480.

Referring specifically to FIG. 15, the fastening mechanism 470 is moved to the tightened configuration by rotation of both the proximal tensioning member 476 in the first direction 524 about the tensioning member axis 484 and also the distal tensioning member 480 in the second direction 526 that is opposite the first direction 524. As such, the proximal tensioning member 476 includes a proximal protrusion 570 and the distal tensioning member 480 includes a distal protrusion 586. The proximal and distal protrusions 570, 586 each extend outwardly from the outer surfaces 528, 532, respectively, and are configured to be gripped by a user's hand to rotate the proximal and distal tensioning members 476, 480. As the distal tensioning member 480 is rotated in the second direction 526, the second ends 580*b* of the first plurality of tensioning elements 580 move with the distal tensioning member 480 in the second direction while the first ends 580*a* remain fixed, such that the first plurality of tensioning elements 580 extend along the upper 402 at a third angle Θ3 relative to the tensioning member axis 484 and measured in each of the first plurality of planes that is greater than the first angle Θ1. Similarly, as the proximal tensioning member 476 is rotated in the first direction 524, the second ends 582*b* of the second plurality of tensioning elements 582 move with the proximal tensioning member 480 in the first direction 524 while the first ends 582*a* remain fixed, such that the second plurality of tensioning elements 582 extend along the upper 402 at a fourth angle Θ4 relative to the tensioning member axis 484 and measured in each of the second plurality of planes that is greater than the second angle Θ2 and is the inverse of the third angle Θ3.

With continued reference to FIG. 15, rotation of the tensioning members 476, 480 in the first and second directions 524, 526, respectively, cause each of the pluralities of tensioning elements 580, 582 having a fixed length to extend at greater angles (from Θ1 to Θ3, and from Θ2 to Θ4, respectively) along the upper 402 relative to the tensioning member axis 484 and measured in each of the first and second pluralities of planes, respectively. Further, in the illustrated embodiment, the inner surfaces 530, 534 of the proximal and distal tensioning members 476, 480 are fixed to the upper 402 and at least the upper side 562 of the sole aperture 560, such that a length L2 (see FIG. 16) between the tensioning members 476, 480 is fixed. Therefore, rotation of the tensioning members 476, 480 causes both the first and second pluralities of tensioning elements 580, 582 to be tensioned to the second tension, which pulls the lateral side 416 and the medial side 418 of the upper 402 inward and also pulls the instep region 458 of the upper 402 downwards toward the sole structure 404. Moreover, in the illustrated embodiment, the tensional force from the first and second pluralities of tensioning elements 580, 582 tensioned to the second tension is more uniformly distributed along the upper 402 as the pluralities of tensioning elements 580, 582 extend across the upper 402 in a crisscrossing-manner.

Referring again to FIGS. 14 and 15, in some embodiments, the first angle Θ1 of the first plurality of tensioning elements 580 relative to the tensioning member axis 484 and measured in each of the first pluralities of planes can be greater than an inverse of the second angle Θ2 of the second plurality of tensioning elements 582 relative to the tensioning member axis 484 and measured in each of the second plurality of planes, or vice versa. In some embodiments, the one or more of the tensioning elements of the first plurality of tensioning elements 580 can extend along the upper 402 at an angle that is less than or greater than the first angle Θ1 relative to the tensioning member axis 484 and measured in each of the first plurality of planes. In some embodiments, one or more of the tensioning elements of the second plurality of tensioning elements 582 can extend along the upper 402 at an angle that is less than or greater than the second angle Θ2 relative to the tensioning member axis 484 and measured in each of the second plurality of planes. In some embodiments, a ratio between the first and second angles Θ1, Θ2 and the third and fourth angles Θ3, Θ4, respectively, relative to the tensioning member axis 484 and measured in each of the first and second pluralities of planes, respectively, is in a range of about 1:17 to about 10:11, in a range of about 1:13 to about 10:15, or in a range of about 1:11 to about 10:19.

Figure 16:
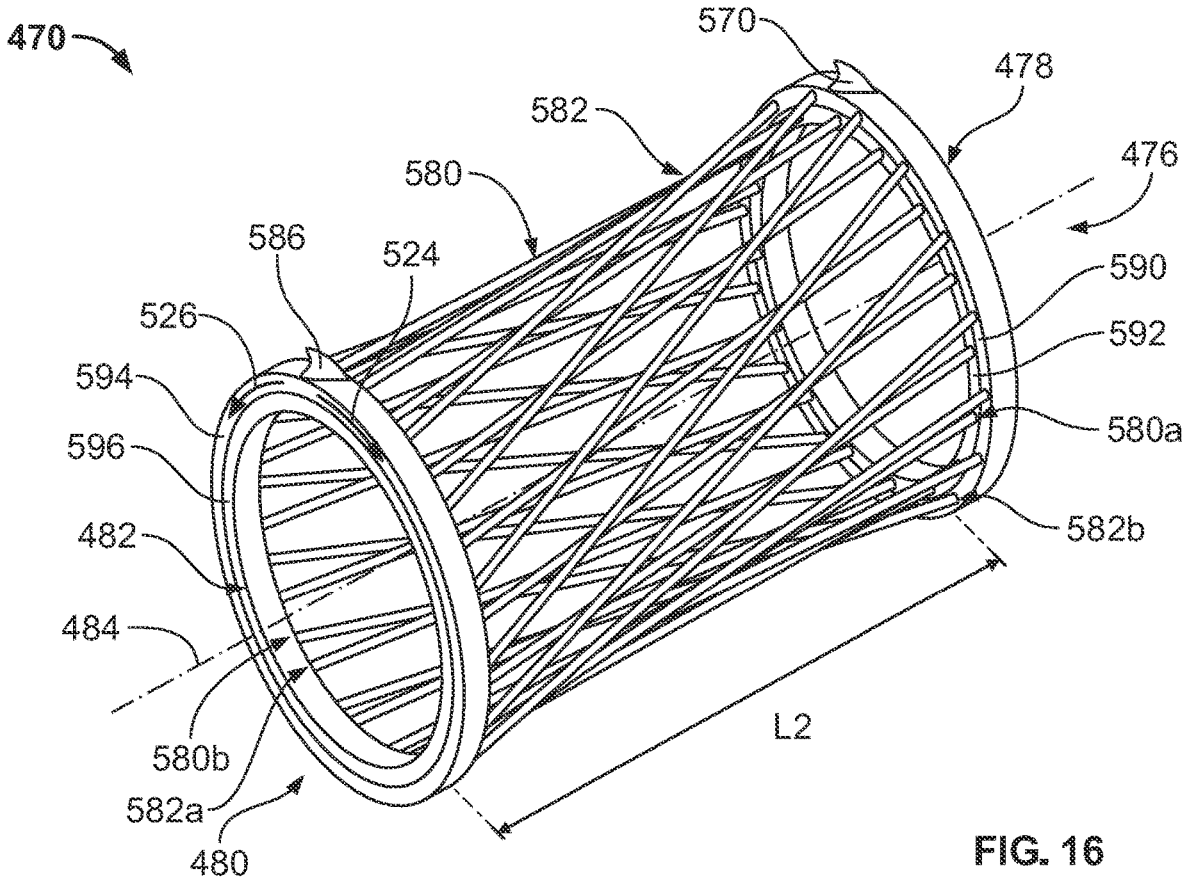
FIG. 16 is a perspective view of another example fastening mechanism of the article of footwear of FIG. 10, according to another embodiment of the disclosure.
Figure 17:
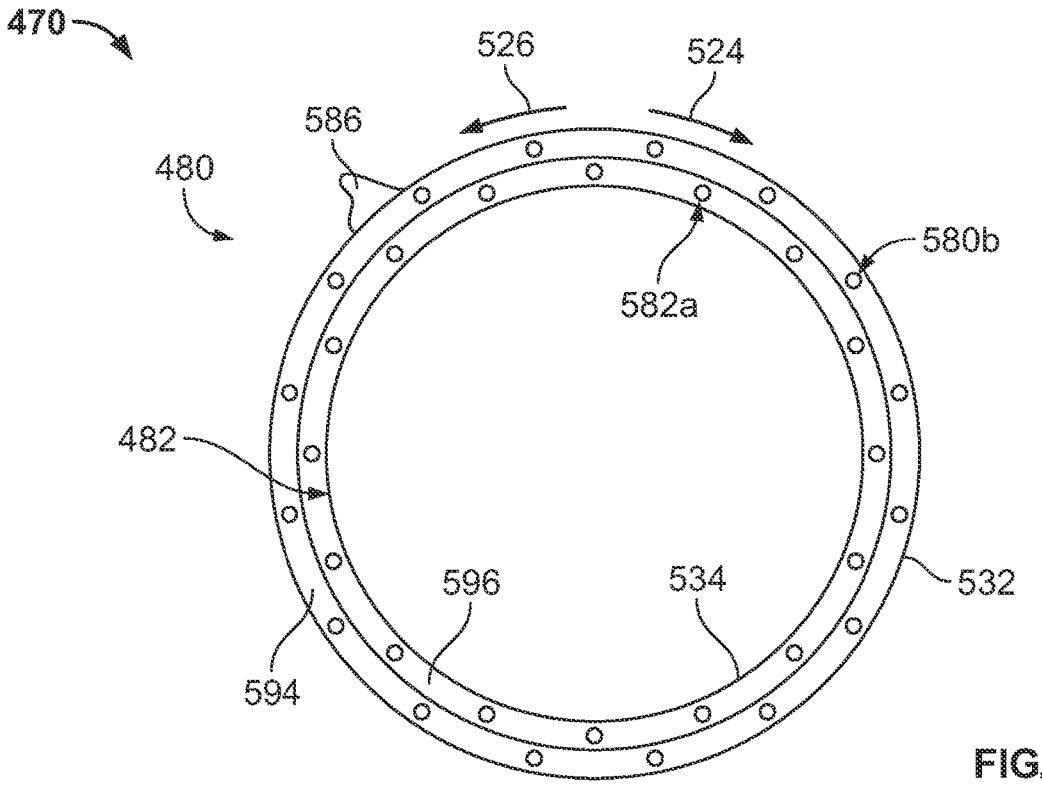
FIG. 17 is a front plan view of a proximal tensioning member of the fastening mechanism of FIG. 16.

It is contemplated that at least one of the proximal tensioning member 476 and/or the distal tensioning member 480 can include a fixed inner tensioning member and a rotatable outer tensioning member. Referring now to FIGS. 16 and 17, for example, another embodiment of the fastening mechanism 470 is depicted. The fastening mechanism 470 of the article of footwear 400 of FIGS. 16 and 17 is similar to the previous embodiments of FIGS. 10-15, with like elements being indicated by similar reference numerals. In the illustrated embodiment of FIGS. 16 and 17, the proximal tensioning member 476 includes an outer tensioning member 590 and an inner tensioning member 592 arranged within the outer tensioning member 590, and the distal tensioning member 480 includes an outer tensioning member 594 and an inner tensioning member 596 arranged within the outer tensioning member 594. Referring to FIGS. 10 and 16, in the illustrated embodiment, the inner surfaces 530, 534 of the inner tensioning members 592, 596 of the proximal and distal tensioning members 476, 480 can be fixedly attached to the upper 402 and at least the upper side 562 of the sole aperture 560 of the sole structure 404. As such, the outer tensioning members 590, 594 of the proximal and distal tensioning members 476, 480 can be rotated in the first and second directions 524, 526 about the tensioning member axis 484 while the inner tensioning members 592, 596 remain fixedly in place.

Referring to FIG. 16, the first ends 580*a* of the first plurality of tensioning elements 580 are fixedly attached to the inner tensioning member 592 of the proximal tensioning member 476 while the second ends 580*b* (see FIG. 17) are fixedly attached to the outer tensioning member 594 of the distal tensioning member 480. Similarly, the first ends 582*a* (see FIG. 17) of the second plurality of tensioning elements 582 are fixedly attached to the inner tensioning member 596 of the distal tensioning member 480 while the second ends 582*b* are fixedly attached to the outer tensioning member 590 of the proximal tensioning member 476. Referring to FIG. 17, with at least the distal tensioning member 480 in this configuration, the second ends 580*b* of the first plurality of tensioning elements 580 move with the outer tensioning member 594 of the distal tensioning member 480 while the first ends 582*a* of the second plurality of tensioning elements 582 remain stationary on the fixed inner tensioning member 596 of the distal tensioning member 480 when the fastening mechanism 470 is moved to the tightened configuration (as shown in FIG. 15). In some embodiments, each of the inner tensioning members 592, 596 and the outer tensioning members 590, 594 of the proximal and distal tensioning members 476, 480 may comprise a material having elastomeric properties. In some embodiments, the outer tensioning members 590, 594 may comprise a first material and the inner tensioning members 592, 596 may comprise a second material having greater elasticity than the first material. In some embodiments, the inner tensioning members 592, 596 of the proximal and distal tensioning members 476, 480 can be defined at ends of a single unitary piece that defines a tension member tube (not shown) extending between the inner tensioning members 592, 596. In such embodiments, the tension member tube can extend along at least the upper 402 of the article of footwear 400 and at least some of the tensioning elements of the pluralities of tensioning elements 580, 582 can extend along an exterior surface of the tension member tube.

Referring again to FIGS. 16 and 17, it is contemplated that the fastening mechanism 470 can include the tension holding mechanism 540 (see FIG. 14) that can be configured to engage at least one of the proximal and distal tensioning members 476, 480 to releasably hold the fastening mechanism 470 in the tightened configuration or one of a plurality of tightened configurations. For example, in some embodiments, the tension holding mechanism 540 of the fastening mechanism 470 can be arranged between an inner perimeter of the outer tensioning members 590, 594 and an outer perimeter of the inner tensioning members 592, 596 of the proximal and distal tensioning members 476, 480, which can be configured to hold the outer tensioning members 590, 594 at the desired degree of rotation relative to the fixed inner tensioning members 592, 596.

In some embodiments, the tension holding mechanism 540 of the fastening mechanism 470 can be a ratcheting system that comprises a plurality of teeth arranged along at least one of the inner surfaces 530, 534 of the proximal and/or distal tensioning members 476, 480 and one or more pivoting pawls arranged on the upper, proximal, and/or distal sides 562, 564, 566 of the sole aperture 560 that is configured to releasably engage the plurality of teeth of the proximal and/or distal tensioning members 476, 480. In such embodiments, the one or more pivoting pawls of the ratcheting system can be pivotable via one or more actuators, such as, e.g., the lever or button 546, that can be arranged on the lateral side 416 and/or medial side 418 of the sole structure 404 or the upper 402 of the article of footwear 400, and can be configured to simultaneously pivot two or more pawls such that the proximal and/or distal tensioning members 476, 480 are simultaneously released from the tightened configuration. In some embodiments, the ratcheting system can comprise a plurality of teeth arranged along the outer surfaces 528, 532 of the proximal and/or distal tensioning members 476, 480, respectively, and one or more pivoting pawls arranged on a lower side of the sole aperture that is configured to releasably engage the plurality of teeth of the proximal and/or distal tensioning members 476, 480. In such embodiments, the one or more pivoting pawls of the ratcheting system can be pivotable via one or more actuators, such as, e.g., the lever or button 546, that can be arranged on the lateral side 416 and/or medial side 418 of the sole structure 404 or the upper 402 and/or on the bottom surface 466 (see FIG. 11) of the sole structure 404 of the article of footwear 400.

In some embodiments, the tension holding mechanism 540 of the fastening mechanism 470 can comprise a plurality of protrusions extending outwardly from the upper 402 that are configured to be received by one or more openings or grooves disposed on at least one of the inner surfaces 530, 534 of the proximal and/or distal tensioning members 476, 480, or vice versa. In some embodiments, the tension holding mechanism 540 can comprise a plurality of hooks and a plurality of loops, i.e., corresponding male and female strips of Velcro®. In such embodiments, and referring to FIG. 15, the plurality of hooks can be arranged along at least one of the inner surfaces 530, 534 of the proximal and/or distal tensioning members 476, 480 near the proximal and/or distal protrusions 570, 586, respectively, and the plurality of loops can be arranged along the instep region 458, the lateral side 416, and/or the medial side 418 of the upper 402 of the article of footwear 400 adjacent to the location of the proximal and/or distal tensioning members 476, 480. In such embodiments, and still referring to FIG. 15, the proximal and/or distal tensioning members 476, 480 can be configured to be elastically expanded when a user pulls outwardly on the proximal and/or distal protrusions 570, 586, respectively, such that the plurality of hooks on the inner surfaces 530, 534 are disengaged with a first portion of the plurality of loops of the upper 402, rotated in the first direction 524 to the tightened configuration and/or in the second direction 526 to the loosened configuration, and released such that the plurality of hooks on the inner surfaces 530, 534 of the proximal and/or distal tensioning members 476, 480 reengage a second portion of the plurality of loops on the upper 402.

Referring to FIGS. 4-17, various components of the example articles of footwear 200 and 400 may be formed through additive manufacturing techniques, such as by one or more of the various 3D printing techniques mentioned above. For example, in some embodiments, the various tensioning members 272, 472 of the fastening mechanisms 270, 470 may be 3D printed as a single unitary piece. In other embodiments, the inner tensioning members 280 of the fastening mechanism 270 may be 3D printed separate from the outer tensioning member 276, and then the inner tensioning member 280 may be arranged within the outer tensioning member 276. In some embodiments, one or more portions of the inner tensioning member 280 may be 3D printed with a first material and other portions of the inner tensioning member 280 may be 3D printed with a second material.

In other embodiments, other configurations are possible. For example, certain features and combinations of features that are presented with respect to particular embodiments in the discussion above can be utilized in other embodiments and in other combinations, as appropriate. Further, any of the embodiments described herein may be modified to include any of the structures or methodologies disclosed in connection with other embodiments. Additionally, the present disclosure is not limited to articles of footwear of the type specifically shown. Still further, aspects of the articles of footwear of any of the embodiments disclosed herein may be modified to work with any type of footwear, apparel, or other athletic equipment.

As noted previously, it will be appreciated by those skilled in the art that while the disclosure has been described above in connection with particular embodiments and examples, the disclosure is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the disclosure are set forth in the following claims.

INDUSTRIAL APPLICABILITY

Numerous modifications to the present disclosure will be apparent to those skilled in the art in view of the foregoing description. Accordingly, this description is to be construed as illustrative only and is presented for the purpose of enabling those skilled in the art to make and use the disclosure. The exclusive rights to all modifications which come within the scope of the appended claims are reserved.

I claim:

1. A fastening mechanism for an article of footwear, the fastening mechanism comprising:

a tensioning member having a member opening defined by an inner perimeter of the tensioning member, the tensioning member comprising:

a first tensioning member within the member opening, the first tensioning member having a first straight side and a second straight side, opposite the first straight side, and a second tensioning member that is arranged within the member opening of the first tensioning member, the second tensioning member being configured to be rotatable within the member opening of the first tensioning member;

a first tensioning element configured to extend along a first side of an upper of the article of footwear; and a second tensioning element configured to extend along a second side of the upper, opposite the first side of the upper, wherein the first and second tensioning elements are operatively coupled with the tensioning member about the member opening, wherein the inner perimeter of the tensioning member has a non-circular shape, and wherein the fastening mechanism is configured to be moveable between a loosened configuration, in which the first and second tensioning elements are tensioned to a first tension, and a tightened configuration, in which the first and second tensioning elements are tensioned to a second tension that is greater than the first tension, when the second tensioning member is rotated.

2. The fastening mechanism of claim 1, wherein the first tensioning element has a first end operatively coupled with the tensioning member and a second end configured to be attached to the first side of the upper of the article of footwear, and wherein the second tensioning element has a first end operatively coupled with the tensioning member and a second end configured to be attached to the second side of the upper of the article of footwear.

3. The fastening mechanism of claim 2, wherein the second ends of the first and second tensioning elements are configured to be attached to a sole of the article of footwear.

4. The fastening mechanism of claim 2, wherein the first tensioning element is one of a plurality of first tensioning elements configured to be arranged on the first side of the upper of the article of footwear along a midfoot region and a heel region of the upper, and wherein the second tensioning element is one of a plurality of second tensioning elements configured to be arranged on the second side of the upper of the article of footwear along the midfoot region and the heel region of the upper.

5. The fastening mechanism of claim 2, wherein the fastening mechanism is configured to be moveable from the loosened configuration to the tightened configuration when the second tensioning member is rotated within the first tensioning member in a first direction.

6. The fastening mechanism of claim 5, wherein the first tensioning member has a first aperture and a second aperture, the first and second apertures extending through outer and inner surfaces of the first tensioning member and into the member opening, wherein the first tensioning element extends through the first aperture of the first tensioning member and the second tensioning element extends through the second aperture of the first tensioning member, and wherein the first ends of the first and second tensioning elements are attached to the second tensioning member.

7. The fastening mechanism of claim 5, wherein the second tensioning member is configured to be deformable such that an outer perimeter of the second tensioning member continuously contacts the inner perimeter of the first tensioning member while the second tensioning member is rotated within the member opening of the first tensioning member.

8. The fastening mechanism of claim 7, wherein the second tensioning member comprises an elastomeric material.

9. An article of footwear, comprising:

a sole attached to an upper; and a fastening mechanism, comprising:

a tensioning member having a member opening defined by an inner perimeter of the tensioning member, the tensioning member comprising:

a first tensioning member within the member opening, the first tensioning member having a first straight side and a second straight side, opposite the first straight side, and a second tensioning member that is arranged within the member opening of the first tensioning member, the second tensioning member being rotatable within the member opening of the first tensioning member;

a first tensioning element that extends along a first side of the upper of the article of footwear; and a second tensioning element that extends along a second side of the upper, opposite the first side of the upper, wherein the first and second tensioning elements are operatively coupled with the tensioning member about the member opening, wherein the inner perimeter of the tensioning member has a non-circular shape, and wherein the fastening mechanism is moveable between a loosened configuration, in which the first and second tensioning elements are tensioned to a first tension, and a tightened configuration, in which the first and second tensioning elements are tensioned to a second tension that is greater than the first tension, when the second tensioning member is rotated.

10. The article of footwear of claim 9, wherein the first tensioning element has a first end operatively coupled with the tensioning member and a second end attached to the first side of the upper of the article of footwear, and wherein the second tensioning element has a first end operatively coupled with the tensioning member and a second end attached to the second side of the upper of the article of footwear.

11. The article of footwear of claim 10, wherein the second ends of the first and second tensioning elements are attached to the sole of the article of footwear.

12. The article of footwear of claim 10, wherein the first tensioning element is one of a plurality of first tensioning elements arranged on the first side of the upper of the article of footwear along a midfoot region and a heel region of the upper, and wherein the second tensioning element is one of a plurality of second tensioning elements arranged on the second side of the upper of the article of footwear along the midfoot region and the heel region of the upper.

13. The article of footwear of claim 10, wherein the fastening mechanism is moveable from the loosened configuration to the tightened configuration when the second tensioning member is rotated within the first tensioning member in a first direction.

14. The article of footwear of claim 13, wherein the first tensioning member has a first aperture and a second aperture, the first and second apertures extending through outer and inner surfaces of the first tensioning member and into the member opening, wherein the first tensioning element extends through the first aperture of the first tensioning member and the second tensioning element extends through the second aperture of the first tensioning member, and wherein the first ends of the first and second tensioning elements are attached to the second tensioning member.

15. The article of footwear of claim 13, wherein the second tensioning member is deformable such that an outer perimeter of the second tensioning member continuously contacts the inner perimeter of the first tensioning member while the second tensioning member is rotated within the member opening of the first tensioning member.

16. The article of footwear of claim 15, wherein the second tensioning member comprises an elastomeric material.

* * * * *